US010260844B2

(12) United States Patent
Rovinsky et al.

(10) Patent No.: US 10,260,844 B2
(45) Date of Patent: Apr. 16, 2019

(54) METHOD FOR PERFORMING EXO-ATMOSPHERIC MISSILE'S INTERCEPTION TRIAL

(71) Applicant: ISRAEL AEROSPACE INDUSTRIES LTD., Lod (IL)

(72) Inventors: Jacob Rovinsky, Modiin (IL); Yoav Tourgeman, Ramat Gan (IL)

(73) Assignee: ISRAEL AEROSPACE INDUSTRIES, LTD., Lod (IL)

( * ) Notice: Subject to any disclaimer, the term of this patent is extended or adjusted under 35 U.S.C. 154(b) by 341 days.

(21) Appl. No.: 15/130,526

(22) Filed: Apr. 15, 2016

(65) Prior Publication Data

US 2017/0343325 A1 Nov. 30, 2017

Related U.S. Application Data

(63) Continuation-in-part of application No. 14/861,328, filed on Sep. 22, 2015, now Pat. No. 10,012,481,
(Continued)

(30) Foreign Application Priority Data

Mar. 17, 2008 (IL) ..... 190197
Nov. 3, 2015 (IL) ..... 242428

(51) Int. Cl.
*F41J 2/00* (2006.01)
*F42B 10/60* (2006.01)
(Continued)

(52) U.S. Cl.
CPC ..... *F41J 2/00* (2013.01); *F41G 7/003* (2013.01); *F41G 7/004* (2013.01); *F41G 7/006* (2013.01);
(Continued)

(58) Field of Classification Search
CPC . F41J 2/00; F41J 2/02; F41J 9/08; F41J 9/10; F41G 7/003; F41G 7/004; F41G 7/006;
(Continued)

(56) References Cited

U.S. PATENT DOCUMENTS 1,457,024 A * 5/1923 Franzen ..... B64B 1/40
2,165,610 A * 7/1939 Boyle ..... G09F 21/06 244/33
(Continued)

FOREIGN PATENT DOCUMENTS

DE 27 41 919 A1 3/1979
EP 2533001 A1 12/2012
(Continued)

OTHER PUBLICATIONS

"Explanation of Why The Sensor in The Exoatmospheric Kill Vehicle (Ekv) Cannot Reliably Discriminate Decoys From Warheads", attachment, A letter to the White House Chief of Staff, by Theodore A Postal, Security Studies Program, Massachusetts Institute of Technology, 2000.
(Continued)

*Primary Examiner* — Bernarr E Gregory
(74) *Attorney, Agent, or Firm* — Oliff PLC

(57) ABSTRACT

There is provided an inflatable dummy target comprising a chassis wrapped with a sheet. The chassis can be formed by individual inflatable ducts and can comprise at least two ring-shaped ducts interconnected by one or more elongate ducts. The inflatable dummy target can further comprise rigidizing ducts. The inflatable dummy target geometry can be conical, cylindrical, etc. Optionally, the inflatable dummy target can comprise several attached axi-symmetrical sections, wherein each section has a chassis wrapped with a sheet, the chassis formed by individual inflatable ducts. Optionally, the shape of each section can be selected from
(Continued)

the group consisting of conical, frustoconical and cylindrical forms.

7 Claims, 17 Drawing Sheets

Related U.S. Application Data which is a continuation of application No. 14/063,645, filed on Oct. 25, 2013, now Pat. No. 9,170,076, which is a continuation of application No. 12/405,664, filed on Mar. 17, 2009, now Pat. No. 8,593,328.

(51) Int. Cl.

| | |
|---|---|
| ***F42B 10/62*** | (2006.01) |
| ***F41J 2/02*** | (2006.01) |
| ***F41G 7/00*** | (2006.01) |
| ***F41J 9/08*** | (2006.01) |
| ***F42B 8/12*** | (2006.01) |
| ***F42B 8/24*** | (2006.01) |
| *F41J 9/00* | (2006.01) |

(52) U.S. Cl.
CPC . *F41J 2/02* (2013.01); *F41J 9/08* (2013.01); *F42B 8/12* (2013.01); *F42B 8/24* (2013.01); *F42B 10/60* (2013.01); *F42B 10/62* (2013.01)

(58) Field of Classification Search
CPC .... F42B 8/24; F42B 8/12; F42B 10/60; F42B 10/62; B63B 49/00; B64B 1/60; B64B 1/00; B64B 1/40
USPC ..... 446/220–226
See application file for complete search history.

(56) References Cited

U.S. PATENT DOCUMENTS

| | | | | | |
|---|---|---|---|---|---|
| 2,187,493 | A | * | 1/1940 | Gordon | A63B 65/00 446/220 |
| 2,428,656 | A | * | 10/1947 | Elliott et al. | B64B 1/00 |
| D169,631 | S | * | 5/1953 | Norman et al. | 446/220 |
| 2,651,314 | A | * | 9/1953 | Hasselquist | B63B 7/08 116/63 C |
| 2,700,318 | A | | 1/1955 | Snyder | |
| 2,854,014 | A | * | 9/1958 | Hasselquist | E04H 15/20 |
| 3,079,106 | A | * | 2/1963 | Whitnah | B64B 1/60 |
| 3,184,742 | A | | 5/1965 | Cutler | |
| 3,206,749 | A | | 9/1965 | Chatelain | |
| 3,287,019 | A | | 11/1966 | Arthur | |
| 3,290,681 | A | | 12/1966 | Beteille | |
| 3,327,308 | A | | 6/1967 | Henjum | |
| 3,354,458 | A | | 11/1967 | Rottmayer | |
| 3,452,355 | A | | 6/1969 | Slater | |
| 3,568,192 | A | | 3/1971 | Dawson | |
| 3,626,634 | A | * | 12/1971 | Jones et al. | A63H 33/04 446/121 |
| 3,671,965 | A | | 6/1972 | Rabenhorst et al. | |
| 3,780,300 | A | | 12/1973 | Kott | |
| 3,792,477 | A | | 2/1974 | Tomiyasu | |
| 3,839,940 | A | | 10/1974 | Null | |
| 3,938,151 | A | | 2/1976 | Trenam | |
| 3,994,102 | A | * | 11/1976 | Johnson | E04H 15/20 52/2.21 |
| 4,117,486 | A | | 9/1978 | Sharp | |
| 4,149,166 | A | | 4/1979 | Null | |
| 4,166,597 | A | | 9/1979 | Seifert et al. | |
| 4,167,009 | A | | 9/1979 | Schwartz | |
| 4,184,681 | A | | 1/1980 | Graham, Jr. | |
| 4,305,325 | A | | 12/1981 | Lange et al. | |
| 4,307,665 | A | | 12/1981 | Block et al. | |
| 4,340,197 | A | | 7/1982 | Campbell | |
| 4,465,464 | A | | 8/1984 | Schoenberg | |
| 4,471,358 | A | | 9/1984 | Glasser | |
| 4,695,841 | A | | 9/1987 | Billard | |
| 4,700,190 | A | | 10/1987 | Harrington | |
| 4,829,905 | A | | 5/1989 | Lew et al. | |
| 4,926,181 | A | | 5/1990 | Stumm | |
| 5,026,073 | A | * | 6/1991 | Luttrell et al. | F41J 9/10 |
| 5,040,465 | A | | 8/1991 | Maury | |
| 5,238,406 | A | * | 8/1993 | Littell, III | F41J 2/02 434/11 |
| 5,249,527 | A | | 10/1993 | Schwind | |
| 5,276,496 | A | | 1/1994 | Heller et al. | |
| 5,285,213 | A | | 2/1994 | Tusch | |
| 5,317,163 | A | | 5/1994 | Obkircher | |
| 5,333,528 | A | | 8/1994 | Klestadt et al. | |
| 5,341,718 | A | | 8/1994 | Woodall, Jr. et al. | |
| 5,398,032 | A | | 3/1995 | Tucker et al. | |
| 5,424,741 | A | | 6/1995 | Genovese | |
| 5,493,993 | A | | 2/1996 | Carter et al. | |
| 5,530,445 | A | | 6/1996 | Veazey | |
| 5,566,909 | A | | 10/1996 | Lapins | |
| 5,602,362 | A | | 2/1997 | Billard et al. | |
| 5,765,784 | A | | 6/1998 | Lapins | |
| 5,814,754 | A | | 9/1998 | Mangolds | |
| 5,893,238 | A | * | 4/1999 | Peacock et al. | E04H 15/20 52/2.18 |
| 5,969,660 | A | * | 10/1999 | Veazey | B63B 49/00 |
| 5,970,024 | A | | 10/1999 | Smith | |
| 6,230,629 | B1 | | 5/2001 | Doctor et al. | |
| 6,336,893 | B1 | * | 1/2002 | Chen | A63B 5/11 482/29 |
| 6,410,897 | B1 | | 6/2002 | O'Neill | |
| 6,507,307 | B1 | | 1/2003 | Huber, Jr. | |
| 6,513,438 | B1 | | 2/2003 | Fegg et al. | |
| 6,565,405 | B2 | * | 5/2003 | Hsu | A63B 5/11 446/220 |
| 6,650,269 | B1 | | 11/2003 | Huber, Jr. | |
| 6,833,804 | B2 | | 12/2004 | Atar | |
| 7,205,520 | B1 | | 4/2007 | Busse et al. | |
| 7,246,613 | B1 | | 7/2007 | Mohar | |
| 7,336,216 | B2 | | 2/2008 | Weisbrod | |
| 7,652,234 | B2 | | 1/2010 | Shukrun | |
| 7,978,320 | B2 | | 7/2011 | Wada | |
| 8,593,328 | B2 | | 11/2013 | Rovinsky et al. | |
| 9,170,076 | B2 | | 10/2015 | Rovinsky et al. | |
| 2003/0064861 | A1 | * | 4/2003 | Chen | A63B 5/11 482/27 |
| 2004/0107491 | A1 | * | 6/2004 | Publicover | A63B 5/11 4/498 |
| 2006/0049974 | A1 | | 3/2006 | Williams | |
| 2007/0017281 | A1 | | 1/2007 | Rodgers et al. | |
| 2007/0040061 | A1 | | 2/2007 | Williams | |
| 2007/0046524 | A1 | | 3/2007 | Weisbrod | |
| 2007/0052806 | A1 | | 3/2007 | Bnayahu et al. | |
| 2008/0017752 | A1 | | 1/2008 | Shukrun | |
| 2008/0208514 | A1 | | 8/2008 | Weber et al. | |
| 2008/0314234 | A1 | | 12/2008 | Boyd et al. | |
| 2008/0316462 | A1 | | 12/2008 | Riel et al. | |
| 2009/0226109 | A1 | | 9/2009 | Warren et al. | |
| 2011/0141476 | A1 | | 6/2011 | Schmaelzle et al. | |
| 2012/0150484 | A1 | | 6/2012 | Odhner | |
| 2012/0286147 | A1 | | 11/2012 | Hvass et al. | |

FOREIGN PATENT DOCUMENTS

| | | | | | |
|---|---|---|---|---|---|
| FR | 2 519 134 | A1 | | 7/1983 | |
| GB | 2172026 | A | * | 9/1986 | E04H 15/20 |
| GB | 2188507 | A | | 9/1987 | |
| JP | 2003-114096 | A | | 4/2003 | |
| WO | 01/20361 | A1 | | 3/2001 | |
| WO | 2006/025049 | A1 | | 3/2006 | |
| WO | 2007/015698 | A2 | | 2/2007 | |

OTHER PUBLICATIONS

A news feature published on www.ynet.co.il <http://www.ynet.co.il> on Aug. 27, 2001 titled: "Test: The Hetz (Arrow) 2 system successfully intercepted a ballistic missile". The feature itself may

(56) References Cited

OTHER PUBLICATIONS be found in: <http://www.ynet.co.il/articles/0,7340,L-1059149,00.html> (with translation).
"The W-78 Warhead, Intermediate Yield Strategic ICBM MIRV Warhead", Sep. 1, 2001 (retrieved from nuclearweaponarchive.org/Usa/Weapons/W78.html).
"Vandenberg LF03 Chronology", Encyclopedia Astronautica, Aug. 29, 2012 (retrieved from http://www.astronautix.com/sites/vanglf03.htm).
Postol, Theodore "Security Studies Program, Massachusetts Institute of Technology", May 11, 2000 (retrieved from . http://www.fas.org/spp/starwars/program/news00/postol_051100.html May 11, 2000).
Waswa, M.B. Peter "Spacecraft Design-for-Demise Strategy, Analysis and Impact on Low Earth Orbit Space Missions", Feb. 1, 2009.
Partial International Search Report dated Dec. 28, 2009 in International Patent Application No. PCT/IL2009/000303.

* cited by examiner

DYNAMIC EQUATIONS NOZZLE TRUST F

91 $F = P_C \cdot A_{EXIT} \cdot Cf$

92 F = THE NOZZLE THRUST IN [N]

94 $A_{EXIT}$ = NOZZLE AREA IN [$m^2$]

95 Cf = DISCHARGE COEFF. ≅ 1.2

93 $P_C$= PRESSURE IN THE CLOSED VOLUME [$N/m^2$]

INERTIA

- $I_{XX}$ INERTIA AROUND THE X AXIS IN [$kg.m^2$]
- $I_{YY}, I_{ZZ}$ INERTIA AROUND THE Y, Z AXES IN [$kg.m^2$]

DYNAMIC EQUATIONS

97 $\text{PITCH} = \ddot{\theta}_P = \frac{M}{I} = \frac{\Sigma F_i \cdot \ell_i}{I_{YY}}$ 96 $\text{ROLL} = \ddot{\theta}_R = \frac{\Sigma F_j \cdot R_j}{I_{XX}}$

FIG.9A

THE PRESSURE IN THE DUMMY TARGET VOLUME

901 $P_C(t) = \int \frac{(\dot{m}_{in} - \dot{m}_{out})\, RT}{VOL}\, dt$

903 T = GAS TEMPERATURE in [°K]

902 R = Constant (GAS GENERATOR PROPERTIES)

904 $\dot{m}_{in}$ = Rate of flow per unit time Generated by the Gas Generator

905 $\dot{m}_{out}$ = Rate of flow of the Gas flowing out of the dummy target

806 $\dot{m}_{out} = \frac{P_C(t) \cdot A_{exit} \cdot (\text{constant})}{\sqrt{T}} \left[ k/sec \right]$

FIG.9B

METHOD FOR PERFORMING EXO-ATMOSPHERIC MISSILE'S INTERCEPTION TRIAL

This is a Continuation-in-Part of application Ser. No. 14/861,328 filed Sep. 22, 2015, now U.S. Pat. No. 10,012,481; which is a Continuation of application Ser. No. 14/063,645 filed Oct. 25, 2013, now U.S. Pat. No. 9,170,076; which is a Continuation of application Ser. No. 12/405,664 filed Mar. 17, 2009, now U.S. Pat. No. 8,593,328; which claims the benefit of Israeli Application No, 190197 filed Mar. 17, 2008. This application also claims the benefit of Israeli Application No. 242428 filed Nov. 3, 2015. The disclosure of the prior applications is hereby incorporated by reference herein in their entirety.

FIELD OF THE INVENTION

This invention is in the field of performing exo-atmospheric missile's interception trials.

BACKGROUND OF THE INVENTION

Ground to Ground (GTG) missiles have become an efficient weapon which can cause significant damage to military and civilian infra-structures, and thereby they serve as a strategic tool in favor of states which attack their enemies (either offensively or defensively as a result of an attack originated by the enemy). In light of this ever increasing threat, an anti missile technology has been developed, such as the plan designated "star war", the "Arrow" anti-missile technology (deployed and used by the Israel Defense Forces) and others. The and missile technology, such as the Arrow system is capable of tracking the oncoming ground to ground missiles and launch e.g. from a protected territory an anti-missile missile (AMM) (referred to also as kill vehicle—KV) which flies along a flight trajectory which substantially collides with that of the oncoming threat. The anti-missile missile approaches the oncoming threat (at a safe distance from the protected territory) and destroys it by using the hit to kill method or by activating an appropriate kill warhead which destroys at least the active warhead of the threat and thereby prevents the arrival of the threat (or damaging debris) to the protected territory.

In the last few years a wide range of new threats have been introduced such as the Shihab 3, Sihab 2000, Zelzal, Scud D and others, each of which having its unique flight characteristics, such as missile geometry, flight dynamics, IR and or RF signature, etc. The different flight characteristics of each threat impose a new challenge for kill vehicles, which should be upgraded to handle also new threats.

In order to assure proper operation in real life scenarios, the upgraded kill vehicle should be tested against a simulated threat having flight characteristics that resemble that of the real threat. Thus, for example, with the introduction of the Shihab 3 and after obtaining sufficient intelligent information as to the missile's flight characteristics, the kill vehicle should be retrofitted in order to duly handle also this newly introduced threat. In order to validate the efficiency of the kill vehicle against the threat in a real-life scenario, it must undergo field experiments in which it is launched and attempts to intercept the threat. However, typically a country which develops an arsenal of KVs such as Israel, does not have access to a real GTG missile (in the latter example, Israel is not likely to have at its disposal a sample Iranian Shihab 3,) and accordingly the technological challenge is not only to duly retrofit the KV, but also to develop a dummy threat which simulates the flight characteristics of the GTG missile. The latter is normally a costly and long procedure which not only poses financial constraint on the defense project, but also extends the turnkey date, since it normally takes a few years to develop a dummy missile that has exactly the same flight characteristics as that of the GTG missile. By the time that the KV has been successfully retrofitted and tested against the newly introduced threats, new threats may emerge that have not, as yet, been adequately addressed. The defending state is thus exposed to absorb significant damages due to the fact that the KV is not adapted (and duly tested) to destroy newly introduced threats.

It is also known that the destruction of a GTG missile before it hits friendly territory is a difficult task, considering the very high relative velocities between the KV and the GTG missile. The kill duration is thus very short and should be viewed accurately in order to determine whether the warhead portion of the GTG missile has been destroyed. The very short duration during which the hit occurs, as well as the far distance from a ground station (considering that the interception is performed Exo-Atmospheric), poses a significant challenge on tracking means for providing high quality kill assessment.

There is thus a need in the art to provide for a technique for performing Exo-Atmospheric missile's interception trials which can be applicable shortly after introducing of new threats and which significantly simplify (in terms of cost and lime) the procedure of developing a dummy threat that emulates the flight characteristics of the GTG missile.

There is a further need in the art to provide for a method which will facilitate a high quality kill assessment of the interception.

SUMMARY OF THE INVENTION

In accordance with an embodiment of the invention there is provided an inflatable dummy target fittable into a carrier missile capable of being released from the carrier missile during exo-atmospheric flight; upon release, the dummy target or portion thereof is capable of being inflated and manifest characteristics that resemble GTG missile characteristics, wherein said GTG missile characteristics include IR signature, RF signature and GTG missile geometry.

In accordance with an embodiment of the invention there is further provided an inflatable dummy target fittable into a carrier missile capable of being released from the carrier missile during exo-atmospheric flight; upon release, the dummy target or portion thereof is capable of being inflated and manifesting exo-atmospheric flight dynamics that resemble GTG missile exo-atmospheric flight dynamics.

In accordance with an embodiment of the invention there is still further provided a carrier missile accommodating at least one inflatable dummy target, each dummy target capable of being released from the carrier missile during exo-atmospheric flight; upon release, the dummy target or portion thereof is capable of being inflated and manifesting characteristics that resemble GTG missile characteristics, wherein said GTG missile characteristics include IR signature, RF signature and GTG missile geometry.

In accordance with an embodiment of the invention there is still further provided a carrier missile accommodating at least one inflatable dummy target, each dummy target capable of being released from the carrier missile during exo-atmospheric flight; upon release, the dummy target or portion thereof is capable of being inflated and manifesting characteristics that resemble GTG missile characteristics, wherein said GTG missile characteristics include exo-atmospheric flight dynamics.

In accordance with an embodiment of the invention there is still further provided a method for generating dummy target characteristics that resemble (GTG) missile characteristics, comprising:

(a) releasing an inflatable dummy target from a carrier missile;

(b) inflating said dummy target or portion thereof using gas, thereby manifesting dummy target geometry characteristics that resemble the GTG missile characteristics, and whereby the dummy target's characteristics manifest RF signature that resemble missile RF signature and whereby dummy target's characteristics manifests IR signature that resembles IR signature of the GTG missile.

In accordance with an embodiment of the invention there is still further provided a method for generating dummy target characteristics that resemble (GTG) missile characteristics, comprising:

releasing an inflatable dummy target from a carrier missile; inflating said dummy target or portion thereof using gas; and releasing gas through at least one nozzle that is fitted in the dummy target manifesting exo-atmospheric flight dynamics that resemble exo-atmospheric flight dynamics of a GTG missile.

In accordance with an embodiment of the invention there is still further provided an inflatable dummy target fittable into a carrier missile capable of being released in a wrapped form from the carrier missile during exo-atmospheric flight; upon release, the dummy target or portion thereof is capable of being inflated and manifesting exo-atmospheric flight dynamics that resemble GTG missile exo-atmospheric flight dynamics, whereby said dummy target exo-atmospheric flight dynamics are achieved in said inflated form notwithstanding of initial uncontrolled perturbations of the dummy target in a wrapped form.

In accordance with an embodiment of the invention there is still further provided a method for performing exo-atmospheric Ground-to-Ground missile's interception trial, comprising:

(a) launching a carrier accommodating at least one dummy target;

(b) launching an interceptor for exo-atmospheric interception of the dummy target;

(c) releasing an inflatable dummy target from a carrier missile;

(d) inflating said dummy target or portion thereof, the dummy target has characteristics that resemble GTG missile characteristics;

(e) re-routing a flight trajectory of the dummy target during releasing from the carrier for at least (i) facilitate sensing of interception during the END GAME, (ii) assuring that the carrier being substantially out of the field of view of the interceptor during the homing stage and the END-GAME if it is required by interception scenario, and (iii) assuring that the carrier being substantially in the field of view of the interceptor during the homing stage and the END-GAME at the predefined location relative to dummy target if it is required by interception scenario;

(f) sensing the interception process;

(g) communicating the sensed data.

In accordance with an embodiment of the invention there is still further provided a method for simplifying exo-atmospheric Ground-to-Ground (GTG) missile's interception trial, comprising:

(a) providing at least one dummy target that is manufacturable in considerable simpler manufacturing process than a GTG missile, and capable of manifesting characteristics that resemble characteristics of the GTG missile;

(b) providing a common carrier missile capable of accommodating at least one dummy target irrespective of the characteristics thereof;

whereby said common carrier missile is capable of being launched and being configured to release at least one dummy target at selected exo-atmospheric location, for testing the ability of an interceptor missile to intercept said dummy target at exo-atmospheric interception point, thereby testing the interceptor's operational feasibility to destroy the GTG missile.

BRIEF DESCRIPTION OF THE DRAWINGS

In order to understand the invention and to see how it may be carried out in practice, a preferred embodiment will now be described, by way of non-limiting example only, with reference to the accompanying drawings, in which:

FIGS. 9A-B illustrate a set of equations serving for explaining the dynamics exo-atmospheric flight characteristics of a dummy target, in accordance with a certain embodiment of the invention;

DETAILED DESCRIPTION OF THE INVENTION

Unless specifically stated otherwise, as apparent from the following discussions, it is appreciated that throughout the specification discussions, utilizing terms such as, "processing", "computing", "calculating", "determining", or the like, refer to the action and/or processes of a computer or computing system, or processor or similar electronic computing device, that manipulate and/or transform data represented as physical, such as electronic, quantities within the computing system's registers and/or memories into other data, similarly represented as physical quantities within the computing system's memories, registers or other such information storage, transmission or display devices.

Before moving on, it should be noted that in the context of the invention whenever the term ground to ground (GTG) missile is referred to, it likewise applies to reentry vehicle (RV) e.g. in the case of multi stages missiles.

Note also that in the case of an axi-symmetric dummy target, any reference to the pitch axis likewise applies to the yaw axis. For example, pitch angular velocity likewise applies to yaw angular velocity.

Figure 1:
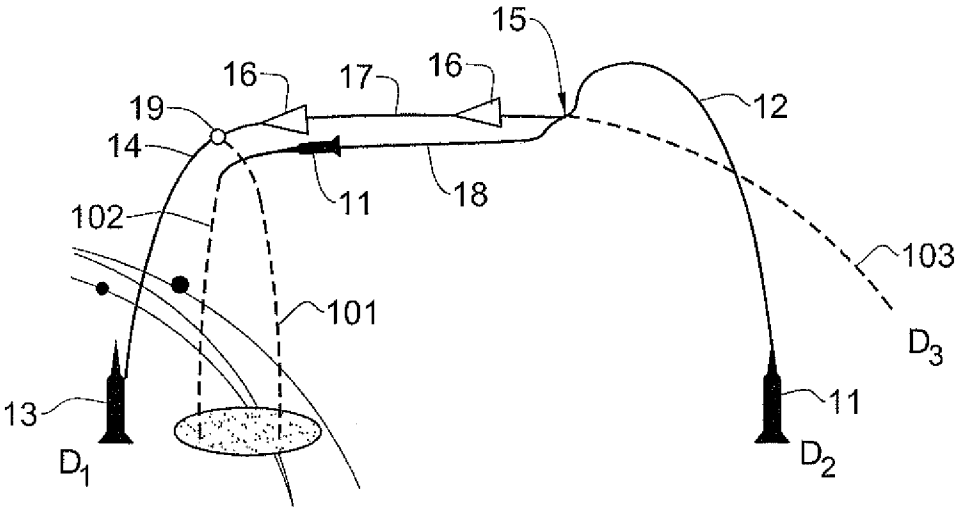
FIG. 1 illustrates a sample dummy target interception scenario, in accordance with embodiments of the invention.

Bearing this in mind, attention is first drawn to FIG. 1 illustrating schematically a sample dummy target interception scenario, in accordance with an embodiment of the invention. As shown, a carrier missile 11 is launched and flies along exo-atmospheric flight trajectory 12. At a certain post boost stage, the motor is separated and discarded (not shown) and the remaining portion of the carrier continues to fly, leaving the atmosphere, and proceeds along an exo-atmospheric flight trajectory. Also shown is an anti-missile missile (KV) (referred to also as interceptor) 13 having an associated radar system (not shown), being configured to track an oncoming GTG missile (in this case the dummy target) and invoke a launch command to the interceptor. The latter flies along an exo-atmospheric flight trajectory 14 that is designated to a collision coarse whereupon the interceptor substantially collides with the oncoming GTG missile (in this case the dummy target).

Note that there are two main killing mechanisms used by target interceptions by interceptors well known from prior art:

- Hit to kill (using of interceptor body for GTG warhead destroying) used typically, although not necessarily, in exo-atmospheric kill scenes.
- Activation killing warhead at a close proximity to the dummy target, a kill warhead that is fitted in the interceptor is invoked, for destroying at least the warhead of the GTG missile, thereby rendering it inoperable. In this case the kill warhead is designated to kill the dummy target. This technique is used typically, although not necessarily, in endo-atmospheric kill scenes.

Choosing of killing method depends on many technical and other uncertainties like typical miss distance at interception, sensitivity of lethality on incidence angle, target characteristics, uncertainties including the exact place of GTG warhead/warhead activator etc. The technique according to the invention is suitable for both types of interceptors killing mechanisms. The only additional limitation for success kill assessment performance in the case of killing warhead mechanisms is that the carrier should be away from the interceptor's warhead fragments beam.

As specified above, in order to assure proper operation in a real life scenario, the KV should be tested against a missile having flight characteristics that resemble that of the real GTG missile threat. Providing an accurate simulated threat of the kind specified normally involves long and costly design and manufacturing procedures which pose inherent limitations that were discussed in detail above.

Thus, in accordance with the invention, there is provided a method for performing exo-atmospheric Ground-to-Ground missiles interception trials. To this end, in accordance with certain embodiments, a carrier 11 that accommodated at least one dummy larger (not shown in FIG. 1) is launched. At a certain location 15, an inflatable dummy target is released from a carrier missile, and upon release, the dummy target is inflated and manifests characteristics that resemble those of a GTG missile, all as will be explained in greater detail below. An interceptor 13 is launched for exo-atmospheric interception of the dummy target. The dummy target 16 continues to fly along the specified flight trajectory (or in accordance with certain embodiments along re-routed flight trajectory 17 as shown in FIG. 1). Note that the reason of re-routing the flight trajectory of the dummy target will be discussed in greater detail below. As will be further discussed below, the dummy target has a simple structure and can be easily manufactured to have characteristics such as IR signature, RF signature, geometry and/or dynamics that resemble those of the GTG missile, in considerable simpler design and manufacturing process than those of simulation missiles as used in accordance with the prior art.

Reverting now to FIG. 1, upon release of the dummy target, the flight trajectory of the carrier missile may be re-routed 18 so as to facilitate sensing of interception process during the homing stage wherein the interceptor 13 attempts to intercept the dummy target at interception point 19. Note also that in accordance with certain embodiments the trajectory of the carrier may be re-routed to ensure that the carrier is substantially out of the field of view of the interceptor during the END GAME if it is required by interception scenario. Otherwise the carrier may be used as an additional object in an interceptor's field of view if that is required by testing the interception scenario (for example for validation of discrimination algorithm etc.)

After having sensed the kill scene, e.g. by acquiring images of the interception process, the sensed data can be communicated, for example, to a remote ground station, for, say assessing the quality of the kill—determining of the key kill parameters like miss distance, incidence angle etc.

The interception scenario that was described in FIG. 1 is by no means binding. For example, the invention is not bound by a carrier of the kind specified, the interception route of the interceptor or the dummy target and die manner of sensing the interception process, etc.

Having described a typical interception scenario, there follows a description (with reference to FIG. 2A) of a sequence of operations for providing dummy target interception, in accordance with certain embodiments of the invention. Thus, at stage 21*a*, a carrier that accommodated at least one dummy target is launched. There follows a staging phase 21*b* and sustainer ignition stage 21*c* for entering the carrier to a desired exo-atmospheric trajectory 21*d*. Note that in 21*d* there is also a re-routing of the carrier's trajectory whenever necessary. Next, at a certain location in the exo-atmosphere, an inflatable dummy target is released 21 from a carrier missile (see also 15 at FIG. 1).

Next (23), the dummy target is inflated such that it has RF signature geometry and other flight characteristics that resemble those of a GTG missile of interest. At this stage 24, the flight trajectory of the dummy target is re-routed (see, for example, 17 in FIG. 1) whilst the carrier keeps tracking the dummy target 25. The re-routing achieves at least the following: (i) the new route deviates from the flight trajectory of the carrier missile (see, for example, 18 in FIG. 1) so as to facilitate sensing of kill scene when the interceptor attempts to intercept the dummy target during the END GAME (for example, exo-atmospheric site 19 depicted in FIG. 1).

Note that in accordance with certain embodiments, the re-routing of the flight trajectory of the carrier is designed accordingly to the interception test objectives:

- to assure that the carrier being substantially out of the field of view of the interceptor during the homing stage 19. This killing scenario is more suitable to non-separate target interception scenarios where the carrier does not form past of the intercepted target. In other words, the interceptor is aimed towards the inflatable dummy target only. In this case it may be desired to retain the carrier outside the FOV of the interceptor during the homing stage, since otherwise the interceptor may home onto the carrier instead of the designated dummy target of interest. The dummy target, as may be recalled, imitates the real target.
- to assure that the carrier is in the field of view of the interceptor at the proper distance for example in case of a multistage target scenario. This scenario is suitable in a situation where the interceptor views the various stages of the target and should discern what the target of interest is. Thus, for example, the interceptor should view (during homing stage) the dummy target (imitating the real target) and the carrier and decide that the real threat is the dummy target, therefore homing onto the latter and ignoring the carrier which does not pose a real threat. Note that the re-routing of the flight trajectory of the carrier may be performed for meeting also other requirements, all as required and appropriate depending upon the particular application.

Figure 2A:
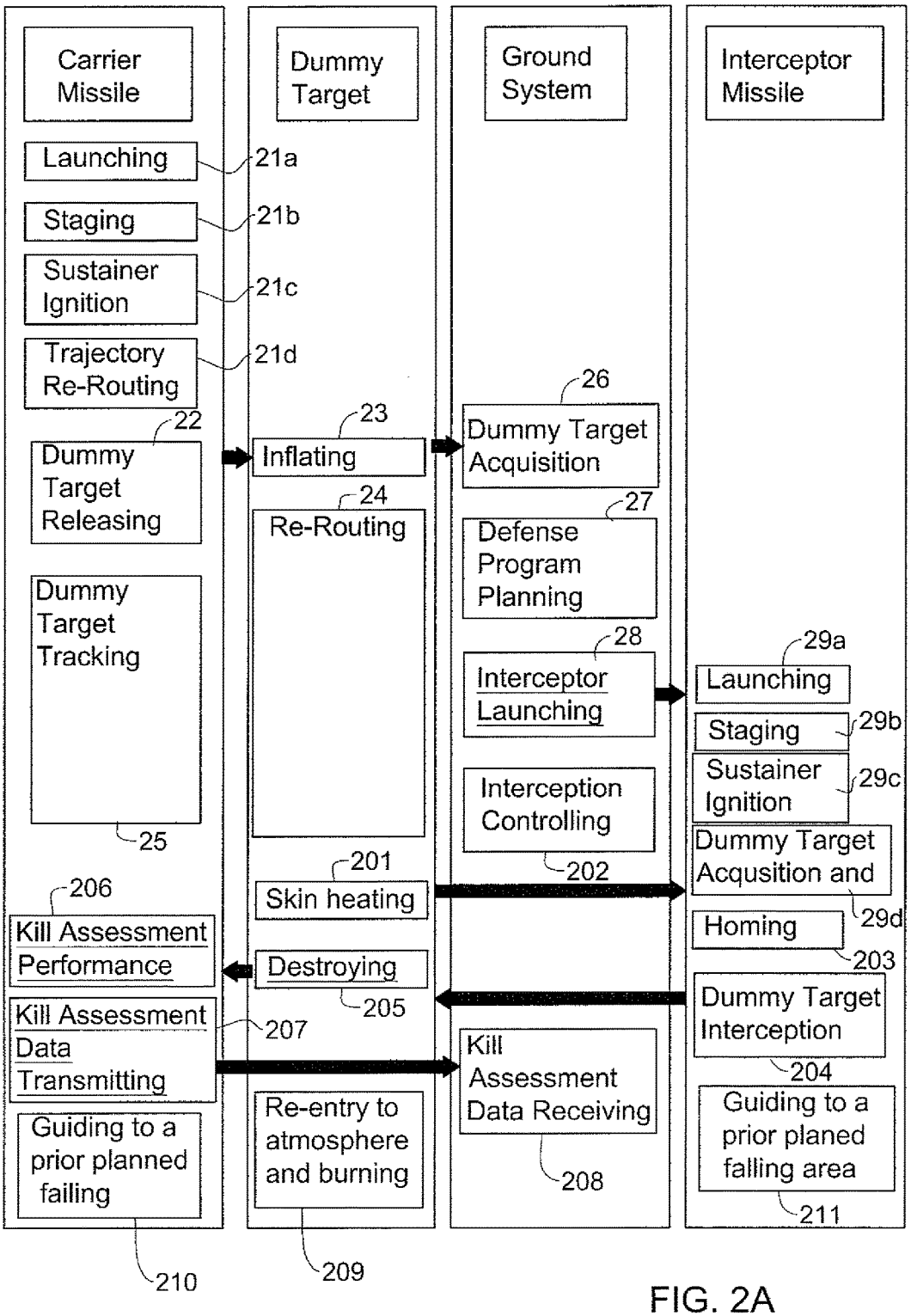
FIG. 2A illustrates a flow diagram of a sequence of operation for providing dummy target interception, in accordance with certain embodiments of the invention.

Reverting to FIG. 2A, while the dummy target is re-routed and the carrier tracks the dummy target (24 and 25, respectively), the ground station (which is in charge of the launching of the interceptor) acquires the dummy target 26 and applies defense program planning 27 for launching the interceptor missile 28. The latter is launched 29*a*, undergoes staging 29*b*, as well as sustainer ignition 29*c* and commences dummy target acquisition sequence 29*d* (only after the dummy target has obtained the desired target characteristics, e.g. it acquired the desired IR signature and to this end, the dummy target skin is heated 201 (as will be explained in greater detail below with reference to FIG. 12).

Simultaneously, the ground control controls the interception sequence 202.

Next, the carrier senses the interception point. The sensing can be achieved by, e.g. image acquisition means attached to the carrier or by way of another non-limiting example by image acquisition means that are released from the carrier for acquiring a sky view of the interception scene at the interception point, all as will be described in greater detail below. The interceptor now homes onto the dummy target 203 and intercepts the dummy target 204 at the interception point. The dummy target is destroyed 205, and the carrier which senses the interception point performs kill assessment 206 and the sensed data is communicated e.g. to a remote ground station 207 which is capable of assessing the success extent of the interception 208. In accordance with certain embodiments, the ability to acquire a sky view of the interception point from a proximate location (say from the carrier or from acquisition means released therefrom) constitutes a significant advantage compared to a situation where the view of the interception scene is obtained from a remote location such as a ground station. Obtaining a sky view from a shorter distance allows a clear view of the kill scene which may facilitate accurate assessment of the interception and, in case of partial or full failure, applying the desired modifications in order to achieve successful results in subsequent trials.

Reverting now to FIG. 2A, after intercepting the dummy target, its debris enter the atmosphere and are burned 209. The carrier (having accomplished its mission) is guided 210 to a prior planned falling area (e.g. in order not to fail onto friendly territory), as will be explained in greater detail below and likewise, the interceptor is guided to a pre-planned falling area 211 (as will be explained in greater detail below).

Figure 2B:
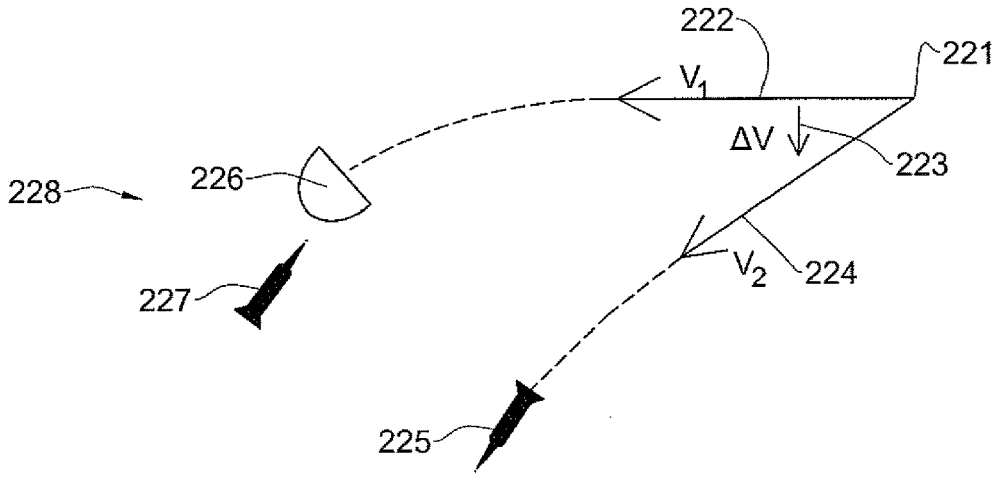
FIG. 2B, illustrates schematically a re-routing technique in accordance with certain embodiments of the invention.

Bearing this in mind, attention is drawn to FIG. 2B, illustrating schematically a re-routing technique in accordance with certain embodiments of the invention. Thus, at the release location (221), the dummy target flies in velocity $V_1$ at a direction depicted schematically by vector $V_1$ (222). There is a need to confer a small lateral velocity component $\Delta v$ (223) ($\Delta v \ll V_1$) which necessary entails deviation of the carrier missile from direction (222) to a re-routed direction designated by vector $V_2$ (224). The lateral velocity component can be realized, e.g. by activating a small rocket or say activating other techniques like pyro technique charge, pneumatic or mechanical energy sources etc. (not shown), all as known per se. The velocity component $\Delta v$ is determined to give rise to a re-routed flight trajectory of the carrier 225 which, as specified above, achieves at least the following: (i) the new route deviates from the flight trajectory of the dummy target (226) so as to facilitate sensing of interception scene when the interceptor 227 attempts to intercept the dummy target at the interception point (228). As also specified above, in accordance with certain embodiments, the re-routing of the flight trajectory of the carrier is designed according to the interception test objectives.

As may be recalled, the dummy target has substantially the same characteristics as those of the simulated GTG missile, and accordingly, if the interceptor succeeds in destroying the dummy target, then the likelihood of successful interception of a real GTG threat by the same type of interceptor, significantly increases.

In accordance with certain embodiments, the Exo-Atmospheric missile's interception trial allows to destroy in a controlled fashion both the interceptor and the carrier missiles after the interception event. This is shown schematically in 101 of FIG. 1, illustrating the falling trail of the interceptor and 102 illustrating the falling trail of the carrier. Assuming that the interception point is selected to be in an unpopulated area (or the sea), both missiles (interceptor and carrier) should sink into the deep sea after the interception test. It should be noted that in accordance with prior art, where the target is a ballistic missile having characteristics that resemble the target GTG missile, the safety range problem is very complicated in case of exo-atmospheric interception:

- The target missile is coming towards Israel and is destroyed by an interceptor during the interception test. As a result, some of high energy uncontrollable target missile debris flies towards the populated area inside the country and there is a risk that the debris will fall in a populated territory or even in a territory of a neighboring country. Such a safety problem is called a "Target debris cloud Safety Problem".
- On the other hand, the interceptor missile is also destroyed during interception and its high energy uncontrollable debris may fly towards the populated territory far away from Israel. Such a safety problem is called an "Interceptor Debris Cloud Safety Problem".
- Some of said debris after the interception process could have a vector of velocity that is significantly different from the velocity of the original missile. This statistical behavior of debris increases the required safety range from interception point to populated territories and in addition defines the maximum altitude of interception tests.
- The complexity of noted safety problems generally eliminates performance of exo-atmospheric interception tests in Israel.
- The proposed method of interception test provides a solution for both types of noted safety problems (Target and Interceptor debris clouds):
- After the interception, there remain two controllable missiles (carrier and interceptor) and parts of the dummy target (in case of successful test) or unharmed dummy target (in case of an unsuccessful test).
- In both cases the dummy target or its parts will be burned during re-entry into the earth's atmosphere and will not reach the earth's surface.
- Unharmed and fully controllable carrier missiles could be led exactly into the appropriate area in the sea.
- Interceptor, after colliding with dummy target, may be lightly damaged and destroyed by fully controlled self destruction mechanisms.
- None of the noted bodies produce dangerous high energy uncontrolled debris during interception In accordance with certain other embodiments, there is a need to simulate a GTG missile that is likely to be launched from a far distance (e.g. from an enemy state). To this end, the carrier should have been launched from a trial territory being of substantially similar distance to what would have been the distance, had the real GTG been launched and in this case the carrier would fly along the longer flight trajectory. Similar to the GTG missile, the dummy target (which simulates the GTG missile) is likely to fly in a similar flight trajectory as that of the real threat, thus simulating a real threat scenario. However, for certain countries (for instance, Israel) which would desire to perform the interception trial in accordance with the teachings of the invention, there is no access to such far territory for launching the carrier therefrom. There is thus a need to launch the carrier missile from a shorter distance (giving rise to shorter flight trajectory), however achieving a flight trajectory that resembles the long one which a GTG missile would have flown, had it been launched from the farther enemy territory. Thus, in accordance with certain embodiments, and as illustrated by way of non-limiting example in FIG. 1, the carrier 11 is launched from location D2 (giving rise to a distance of D2–D1 from the interceptor 13 launching location D1). However, it would have been desired to launch the carrier from location D3 since the distance D3–D1 (>D2–D1) is the actual distance from which a real threat would have been launched, had the enemy committed an act of war. There is thus a need, in accordance with certain embodiments, to cope with the specified limitation where there is no accessible territory at location D3 and nevertheless achieving a flight trajectory that simulates that of a real threat. Thus, in accordance with certain embodiments the carrier is launched from D2, however, when the dummy target is released, it is re-routed to a trajectory having characteristics similar to the longer flight trajectory (i.e. had the carrier been launched from D3). This is illustrated by back tracking the re-routed flight trajectory of dummy target 16 (see trajectory 103 marked in dashed line) to a virtual launching point D3. Of course, D1, D2 and D3 are provided by way of example only and the dummy target can be directed to a different desired trajectory depending on the desired virtual launching location. The re-routed flight trajectory of the dummy target thus simulates a launch of the dummy target from a further distance than the actual launching point of the carrier.

Figure 3A:
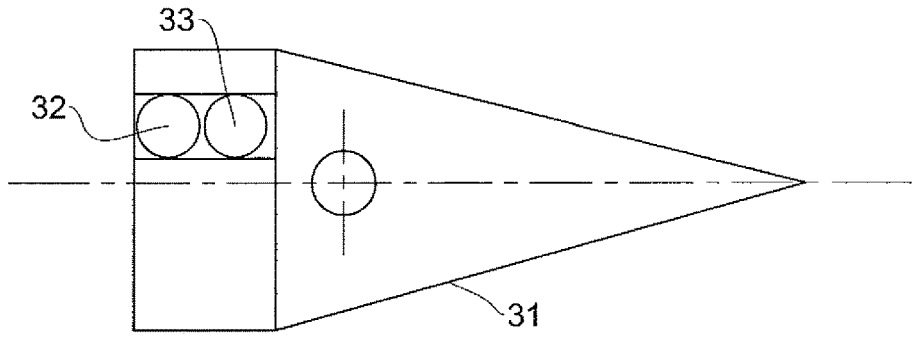
FIG. 3A illustrates schematically a dummy target releasing mechanism, in accordance with an embodiment of the invention.

Having described a typical dummy target interception scenario and a sequence of operational stages in accordance with certain embodiments of the invention, there follows a description that pertains to the dummy target structure and operation in accordance with certain embodiments of the invention. FIG. 3A illustrates schematically a dummy target releasing mechanism, in accordance with an embodiment of the invention. As shown, the carrier 31 accommodates dummy targets 32 and 23 that are located in a designated compartment inside the missile. As will be explained in greater detail below, the dummy targets are stored in the compartment in a wrapped form and are inflated upon release.

Figure 3B:
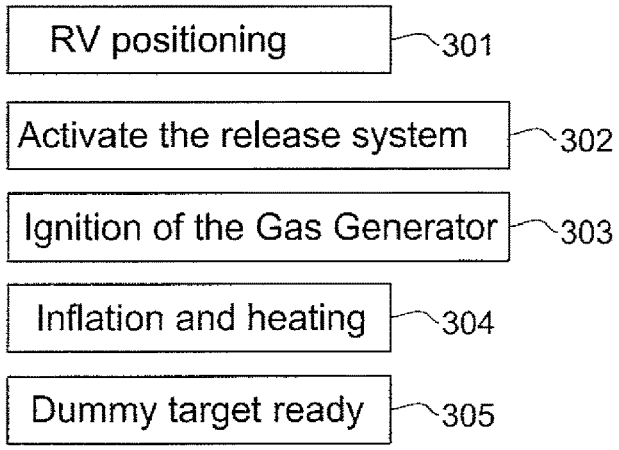
FIG. 3B illustrates schematically a flowchart of the operational stages for releasing and activating a dummy target, in accordance with certain embodiments of the invention.

Turning now to FIG. 3B, there is shown a flowchart of the operational stages for releasing and activating a dummy target, in accordance with certain embodiments of the invention. Thus, when the missile arrives at a given location in space (e.g. 15, as described with reference to FIG. 1, above), 301 a known per se activation means are invoked (e.g. activating pyro technique charge, pneumatic or mechanical energy sources etc.), and the dummy targets are released to the space 302. Upon release, the dummy targets are inflated, using, say, air that is pressurized by a pressure vessel or a gas generator 303 (as described in greater detail below). The air inflates the dummy target 304. The dummy target is now ready 305 and flies in a designated file trajectory (e.g. 17), as described with reference to FIG. 1 above.

Figure 4A:
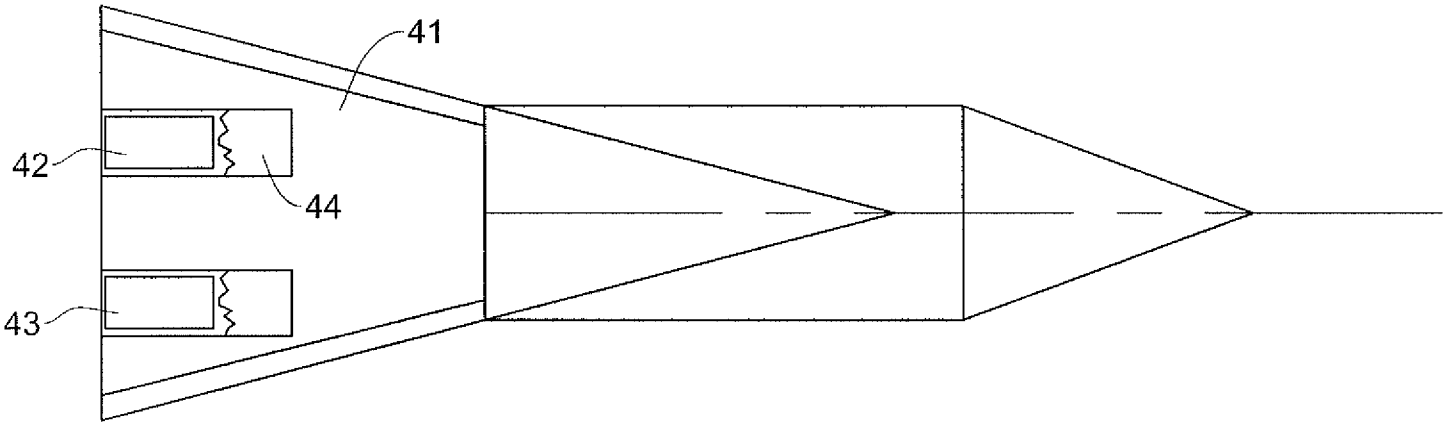
FIGS. 4A-C illustrate schematically a more detailed dummy target releasing mechanism, in accordance with an embodiment of the invention.
Figure 4B:
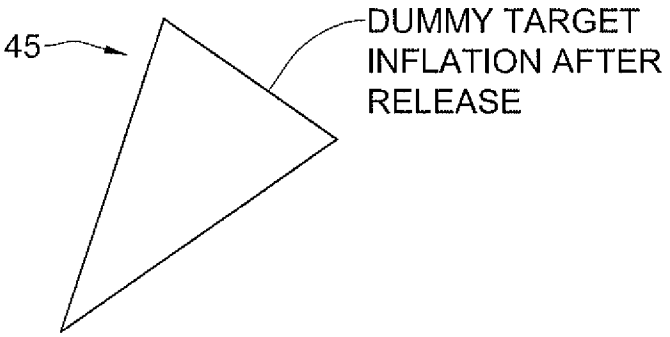
Figure 4C:
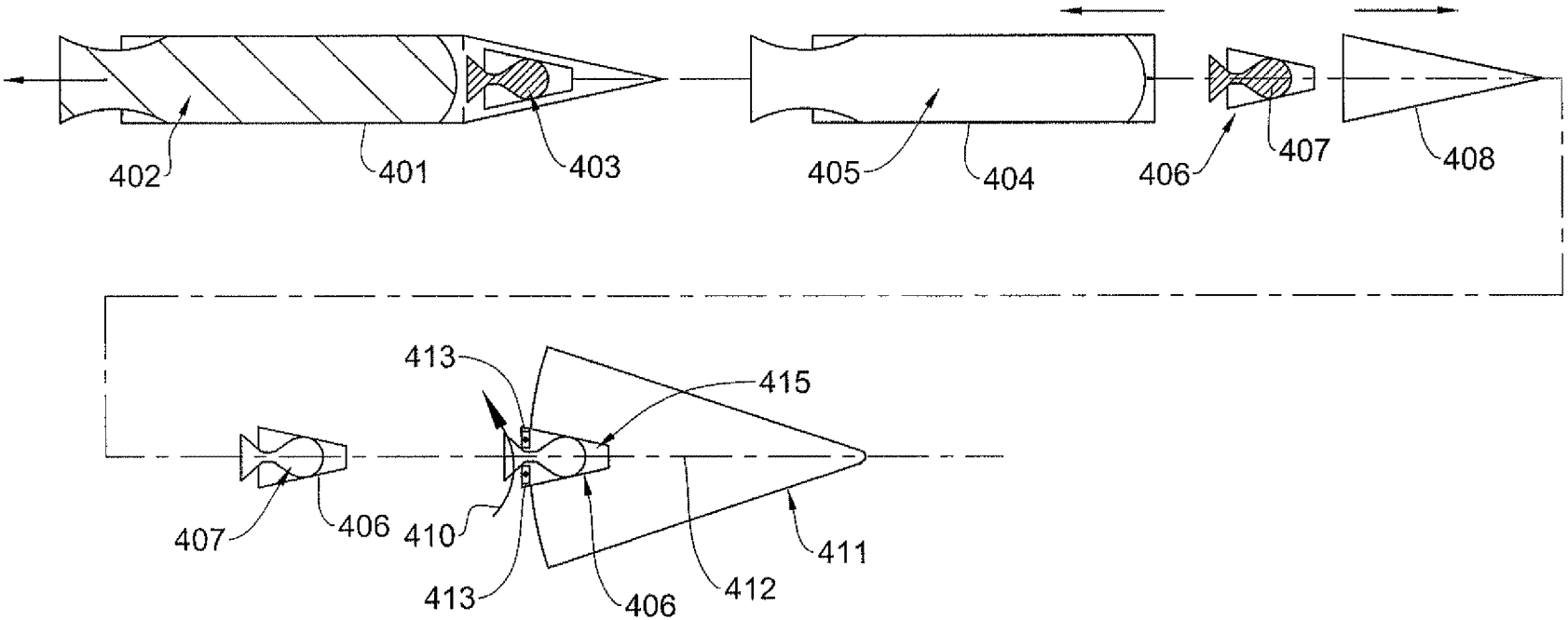

Turning now to FIGS. 4A-C, they illustrate schematically a more detailed dummy target releasing mechanism, in accordance with certain embodiment of the invention. Thus, the dummy targets are accommodated in designated compartment(s) (in this example compartments 42 and 43 of carrier missile 41, such that each compartment accommodates one dummy target in a wrapped form. Upon release, say by invocation of an air bag 44, the dummy target is ejected to space and is filled with air generated by a pressure vessel or a gas generator and transformed (in its inflated state) to an object having geometry that resembles that of the missile 45, as shown in FIG. 4B. As specified above with reference to FIG. 1, the release occurs at a desired stage.

Another case of dummy target assembling and releasing is described in FIG. 4C. The carrier missile 401 flight starts in e.g. configuration with two full solid motors, 402, 403. After the end of the boost stage, the missile separation e.g. out of space, is performed. The first stage 404 with the empty first solid motor 405 and the shroud 408 are separated from the second stage 406 with the full second stage motor 407. The second stage is accelerated by second stage motor 407 and coincides with the desired trajectory 103 of FIG. 1. At this point 409 the second stage motor 407 of the second carrier stage 406 is empty. The dummy target skin 411 is inflated around the carrier 406. The carrier steering mechanism (ACS, 413) can be used for accomplishing rotating the dummy target about the roll axis 412. By this embodiment, the second stage carrier body can simulate the warhead of the real enemy re-entry vehicle. The interception of such a kind of target is not totally free from the debris clouds, but the target debris cloud is significantly reduced in comparison to a regular target. The additional advantage of such configuration is a positive validation of hitting accuracy and lethality (the interceptor should not only hit the target skin, but should do so in the limited area of she target's warhead).

More specifically, by this embodiment, the rigid second carrier stage body 406 simulates a warhead, e.g. a rigid compartment 415 accommodating different kinds of warheads. The interceptor is thus required to penetrate not only the external surface of the dummy target, but rather also the internal rigid structure 406 that simulates the warhead compartment. In accordance with certain embodiments, known per se means can be utilised to assess whether the rigid structure has been destroyed. Typically although not necessarily, the inflation of a dummy target portion around the second stage rigid structure 406 is feasible by virtue of the rigid shroud structure 408 that protects (including thermal protection) the inflatable dummy target portion. By this particular embodiment the rigid warhead compartments forms part of the second stage but this form of rigid structure is not binding.

Figure 5A:
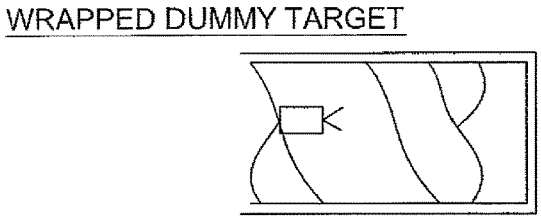
FIGS. 5A-B illustrate schematically a dummy target in wrapped and inflated forms respectively, in accordance with an embodiment of the invention.
Figure 5B:
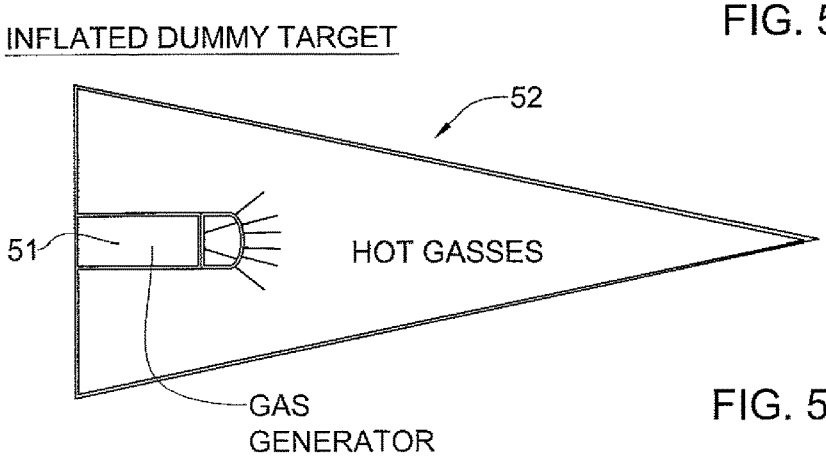

Turning now to FIGS. 5A-B, they illustrate schematically a dummy target in wrapped and inflated forms, respectively, in accordance with certain embodiments of the invention. Thus, the dummy target in its wrapped position is inflated (upon release see FIG. 5B) by gas originating from a known per m pressure vessel or gas generator 51. The gas inflates the dummy target such that its geometry 52 resembles that of the missile.

In accordance with certain embodiments the dummy target is devoid of active self inflation means (such as the specified gas generator), and therefore the dummy target is inflated utilizing a source that is accommodated in the carrier platform. By this embodiment, the inflatable dummy target is released in a wrapped form and is inflated e.g. by using a passive inflating source such as passive pressure vessels (that a priori accumulate pressure or are charged through the carrier source.

A non limiting manner for achieving desired RF signature is by coating the skin of the dummy target with a proper material, thereby achieving RF signature that resembles that of the flying missile and the temperature such that it manifests an IR signature that resembles that of the flying missile. The dummy target skin may be heated by using known prior art methods like:

Chemical surface healing by known per se electrically activated composition, which, upon activation, can generate a desired temperature which extends for a pre-defined duration Dummy target surface heating by the gas injected by gas generator. In this case, in accordance with certain other embodiments, there is employed another gas generator (not shown) which is configured to serve as a backup for maintaining a required temperature (for achieving the designated IR signature) and for generating sufficient internal pressure so as to keep the geometry of the dummy target substantially intact. The invention is not bound by the number of gas generators that are used.

The dummy target surface may be heated also by using son power when the interception test is performed in daylight conditions. The needed IR signature can be achieved by using an appropriate coating layer of the dummy target skin.

In accordance with the embodiments described above, the dummy target manifests IR signature and/or RF signature and/or geometry characteristics that resemble those of the missile.

Figure 6A:
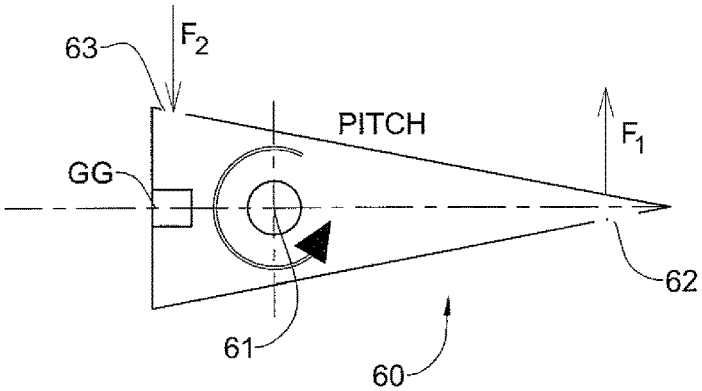
FIGS. 6A-B illustrate schematically front and side views of a dummy target in accordance with an embodiment of the invention.
Figure 6B:
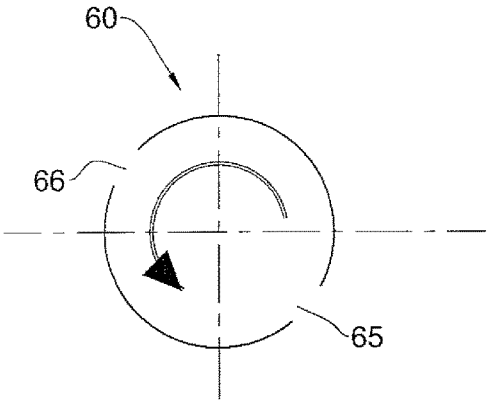

There follows a description in accordance with certain embodiments of the invention which concerns achieving exo-atmospheric flight dynamics of the dummy target that substantially match that of the missile. Thus, attention is now drawn to FIGS. 6A-B, illustrating schematically front and side views of a dummy target, serving for explaining dynamic equations, in accordance with an embodiment of the invention. As shown, in the side view of FIG. 6A, two nozzles are fitted in the dummy target (at locations 62 and 63). In response to ejection of gas from the specified nozzles, two opposite forces F1 and F2 are applied to dummy target 60 forcing a pitch movement of the dummy target about lateral axis 61 (constituting the center of gravity of dummy target 60). In addition, and as shown in a front view of the dummy target 60 (FIG. 6B), two additional nozzles 65 and 66 force roll motion of the dummy target in response to ejection of gas therethrough. By this example, the pitch motion illustrated in FIG. 6A and the roll motion illustrated in FIG. 6B give rise to dummy target exo-atmospheric flight dynamics that should resemble those of the Ground to Ground missile. As will be explained in detail below, in accordance with certain embodiments, the gas pressure inside the dummy target and nozzle dimensions are exemplary parameters which are a priori designed to achieve the desired pitch and roll motions.

Figure 6C:
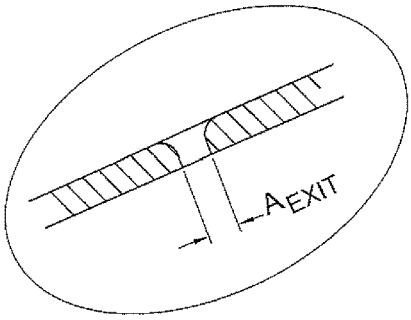
FIG. 6C illustrates schematically an enlarged view of a nozzle fitted in a dummy target, in accordance with an embodiment of the invention.

FIG. 6C illustrates a lateral cross section of a nozzle, in accordance with certain embodiments of the invention. The nozzles depicted in the embodiments of FIGS. 6B and 6C (e.g. 62 of FIG. 6A) may have the shape as illustrated by way of example in FIG. 6C. Note that the invention is not bound by the use of 2 nozzles per channel (i.e. pitch or roll) as depicted by way of example with reference to FIGS. 6B and 6C. In accordance with certain embodiments, the number of nozzles in the roll channel for the self-contained dummy target are at least two and the number of nozzles in the pitch channel is at least one.

In the case of using the carrier, capabilities as were noted above with reference to FIG. 4C, for inflating the gas, spin velocity (roll channel) of the dummy target may be created by spinning of the carrier steering (ACS) 413.

Figure 7A:
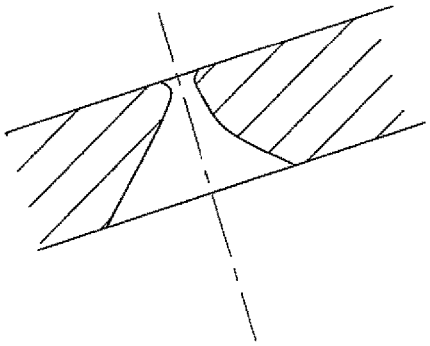
FIGS. 7A-B illustrate schematically nozzle shapes fitted in a dummy target, in accordance with an embodiment of the invention.
Figure 7B:
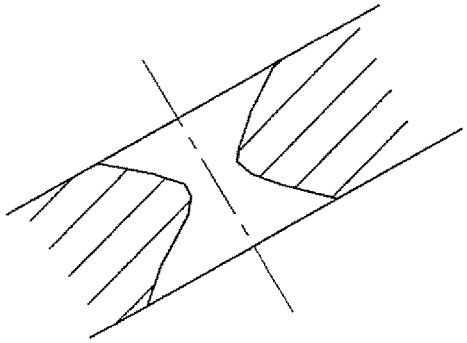

Note also that the invention is not bound by the specific locations of the nozzles in the periphery of the dummy target. The invention is likewise not limited to the specific nozzle shape as depicted in FIG. 6C. Other non limiting examples of nozzles are illustrated in FIG. 7A and FIG. 7B.

Turning now to FIGS. 8 and 9, they illustrate schematically front 81 and side 82 views of a dummy target, serving for explaining dynamic equations, in accordance with an embodiment of the invention. FIGS. 9A-B illustrate sets of equations serving for explaining the dynamics exo-atmospheric flight characteristics of a dummy target, in accordance with certain embodiments of the invention.

Figure 8A:
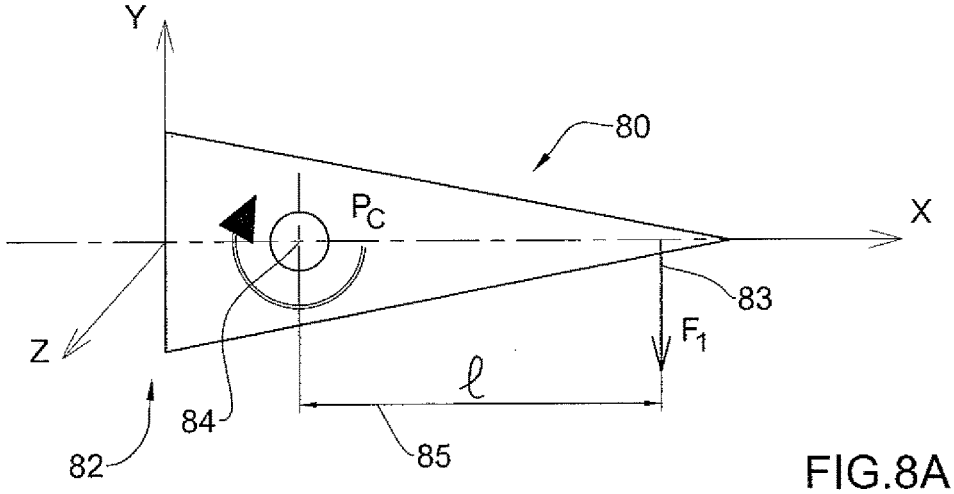
FIGS. 8A-B illustrate schematically respective front and side views of a dummy target, serving for explaining dynamic equations, in accordance with an embodiment of the invention.
Figure 8B:
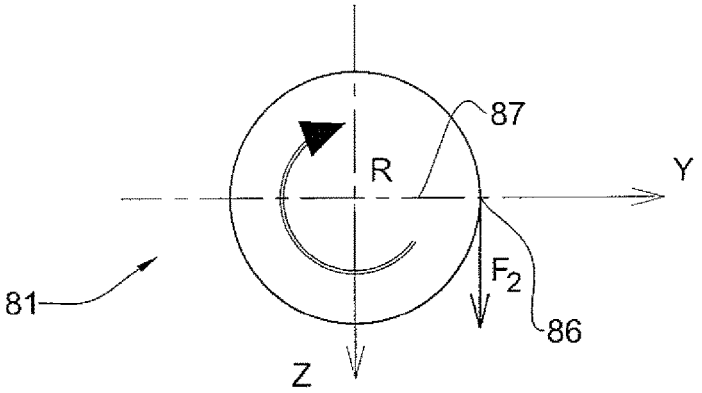
Figure 10A:
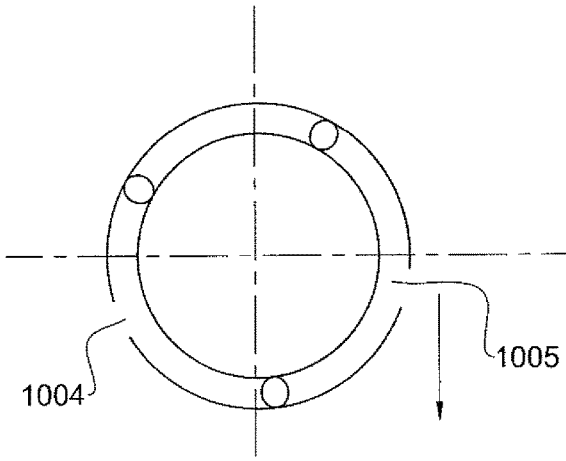
FIGS. 10A-D illustrate schematically a dummy target in accordance with another embodiment of the invention.
Figure 10B:
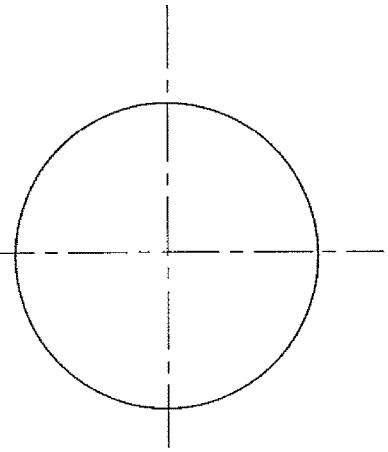
Figure 10C:
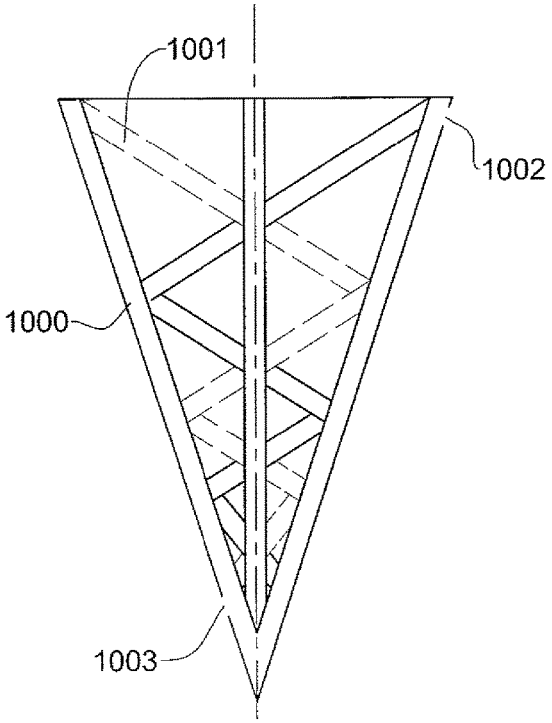
Figure 10D:
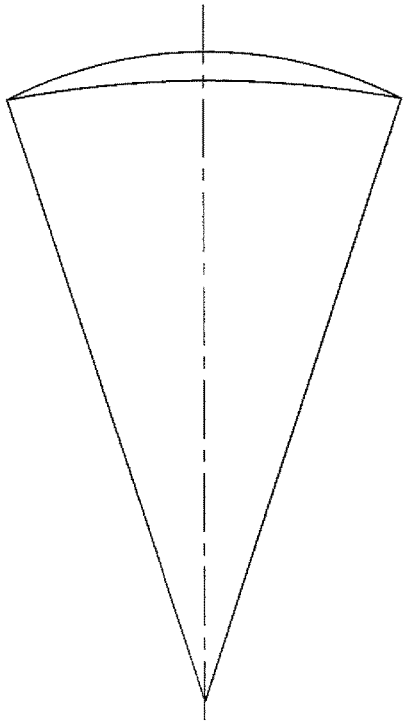

Turning at first to the side view, it shows one nozzle fitted in the dummy target (at locations 83). Note that unlike FIG. 6, where two nozzles are depicted in the example of FIG. 8A, only one is depicted. As was explained above, the invention is not bound to the use of one or two nozzles. As shown, in response to ejection of gas from the specified nozzle 83, a force F1 is applied to dummy target 80 forcing a pitch movement of the dummy target about lateral axis 84 (constituting the center of gravity of dummy target 80). The pitch motion is around the Z axis. Due to the symmetric shape of the dummy target, it moves in a similar fashion about the Y axis. As will be explained in greater detail with reference to the equations of FIG. 9 A (85 in FIG. 8A) the distance between the center of gravity and the nozzle is designated. $P_C$ stands for the gas pressure inside the dummy target. Turning now to FIG. 8B, it shows a front view of the dummy target. By this example (unlike FIG. 6B), only one nozzle 86 is utilized, wherein in response to release of gas through the nozzle, a force F2 is generated and applied to the dummy target giving rise to roll motion about axis X. R (87) stands for the radius of lateral circular cross section of the dummy target that crosses the nozzle.

As will be explained below with reference to FIG. 9, the motion of the dummy target in the roll and pitch channels, gives rise to dummy target exo-atmospheric flight dynamics that resemble those of the Ground to Ground missile.

It should be noted that in order to achieve exo-atmospheric flight dynamics of the dummy target that resembles that of the missile, the dummy target should develop angular accelerations in the pitch channel and the roll channel that will give rise to corresponding angular velocity which substantially matches that of the missile. Moreover, the angular accelerations (in the respective channels) should be dropped to substantially zero once the target velocities are achieved. Having achieved the desired velocities (and eliminating the acceleration), the dummy target will maintain these angular pitch and roll velocities as it flies in space, thus achieving exo-atmospheric flight dynamics that resemble those of the GTG missile. The set of equations described below with reference to FIGS. 9A and 9B will explain how to obtain desired angular accelerations in the specified channels.

Bearing this in mind, attention is drawn to FIG. 9A, illustrating a set of equations serving for explaining the dynamics exo-atmospheric flight characteristics of a dummy target, in accordance with a certain embodiment of the invention. Thus, and as shown in equation 91, F stands for the nozzle thrust (see e.g. F1 in FIG. 8A) and is calculated as the product of $P_C$ (signifying the pressure in the closed volume of the dummy target, see e.g. FIG. 8A) 93, $A_{exit}$ signifying Nozzle area (94) and a coefficient $C_f$ 95 having a value of ~1.2. Note that $A_{exit}$ is easily measurable and $C_f$ is constant. The calculation of $P_C$ is discussed in more detail with reference to FIG. 9B below, and, accordingly, F can be calculated.

The angular accelerations in the roll channel and the pitch channel (96 and 97, respectively) are calculated as Inertial Moment M divided by Inertia I. As shown, for example in equation 97, M is calculated as a summed product of F and l where the former is given in equation 91 (and discussed above) and the latter is a priori known (see 85 in FIG. 8A). The Σ over i sums i products of F and l, where i stands for the number of nozzles. (In the embodiment of FIG. 8A only 1 nozzle is utilized). In the example of calculating angular acceleration in the pitch channel (equation 97), the relevant Inertia is along either the Y axis (or symmetrically the Z axis) and therefore is designated in 97 as $I_{YY}$. Note that $I_{YY}$ measurable in a well known manner to a person of ordinary skill in the art.

Similarly, in equation 96 (defining the angular acceleration in the roll channel), M is calculated as a summed product of F and R where the former is given in equation 91 (and discussed above) and the latter is a priori known (see 87 in FIG. 8B). The Σ over j sums j products of F and R, where j stands for the number of nozzles (by the embodiment of FIG. 8B only 1 nozzle is utilized). In the example of calculating angular acceleration in the roll channel (equation 96), the relevant Inertia is along the X axis (and therefore is designated in 97 as $I_{XX}$. Note that $I_{xx}$ is measurable in a well known manner to a person versed in the art.

Moving on to FIG. 9B, there follows a description for calculating $P_C$, which, as may be recalled, is required in order to determine F (see equation 91).

Thus, $P_C$ (t) is dependent upon a constant R (which is determined by pressure vessel or gas generator property), Gas temperature T 903 inside the dummy target, VOL signifies the volume of the dummy target. $m_{in}$ 904 signifies the rate of flow per unit time generated by the pressure vessel or gas generator. This value is determined according to the generator specification. $m_{out}$ 905, in its turn, stands for the rate of flow of the gas flowing out of the dummy target (through the nozzles) and complies with equation 906. Note that the parameters that affect $m_{out}$ are Pc(t) which is determined iteratively (see 901), $A_{exit}$ which is the nozzle's area, T standing for the gas temperature (see 901) and const that is determined by the geometry of the nozzle and the gas property.

It is thus appreciated that the number of nozzles (i and i), the area of the nozzle ($A_{exit}$), the Inertia $I_{YY}$, $I_{XX}$, gas temperature T, dummy target's volume VOL, nozzle location (relative to the center of gravity) R and l, $m_{out}$ (calculated based on the above parameters) and, $m_{in}$ can all be determined in order to obtain the specified desired angular velocity in the pitch and roll channels.

Note also that there is an inherent behavior of the dummy target which supports the desired achievement of pitch and roll angular velocities. Thus, when the dummy target is ejected to space in a wrapped form, it has a small moment of inertia around the three axes and due to a random parasitic load resulting from the ejection process, the wrapped dummy target manifests random angular velocities in the respective axes. After inflation, the moment of inertia dramatically increases (e.g. in about 3 order of magnitude) and consequently the angular velocities in the respective axes are significantly reduced, thereby allowing to control the specified angular roll and pitch velocities, so as to achieve dummy target exo-atmospheric flight dynamics that resemble that of the RV. It is therefore appreciated that the specified process facilitates obtaining desired dummy target exo-atmospheric flight dynamics (in the pitch and roll channels) notwithstanding the initial uncontrolled perturbations.

The required dynamic characteristics may be achieved also by using well known prior art flywheel mechanisms but their use seem problematic for present application because of relatively high weight consumption (flywheels and their power sources).

Note also (and as will be explained in greater detail below), that the invention is not bound by the specified technique for generating appropriate dummy target dynamics.

The exo-atmospheric Ground-to-Ground missile's interception trial has been described with reference to non limiting embodiments of dummy targets as described with reference to FIGS. 5, 6, 7, 8 and 9. There follows a description with reference to FIG. 10 illustrating schematically a dummy target in accordance with another embodiment of the invention. Unlike the dummy target depicted in FIG. 5B, in accordance with this embodiment, the dummy target is not an inflatable whole object (see rear and side views in FIGS. 10B and 10D, respectively), but is rather composed of a chassis of inflatable ducts e.g. 1000, 1001 which are inflated using e.g. a pressure vessel or a gas generator of the kind described above, installed at the dummy target or at the carrier. The pitch and roll dynamics may be achieved using nozzles, e.g. 1002-1003 (in FIG. 10C) for the pitch and the 1004-1005 (in FIG. 10A) for the roll to achieve dynamics that comply with the algorithmic expressions discussed in detail with reference to FIGS. 8-9, *mutatis mutandis*. The ducts are wrapped with appropriate sheets (not shown) giving rise to a dummy target having a shape similar to that described with reference to the embodiments depicted above. The shape of the body achieves the desired geometry characteristics of the dummy target, as discussed in detail above.

Figure 13A:
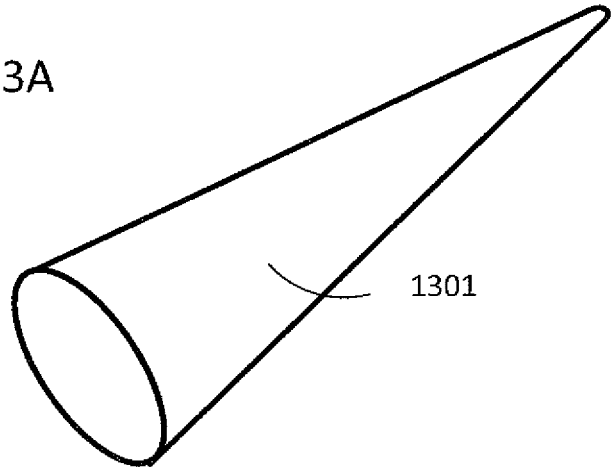
FIGS. 13A-E illustrate schematically inflatable dummy targets with different geometry shapes including both concave and convex shapes, in accordance with certain embodiments of the invention.
Figure 13B:
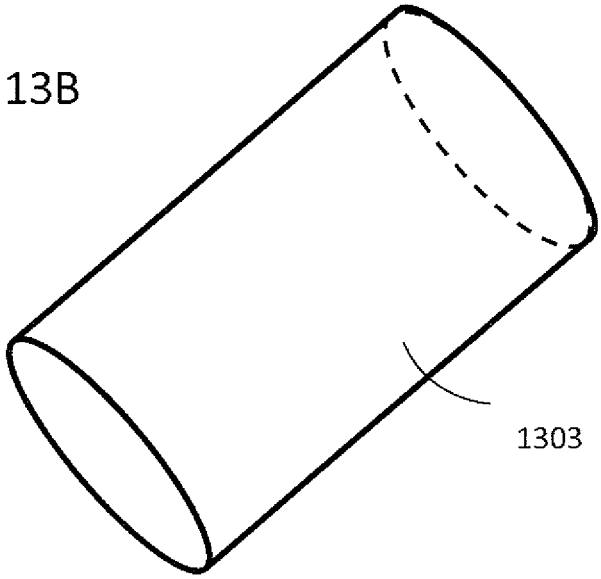
Figure 13C:
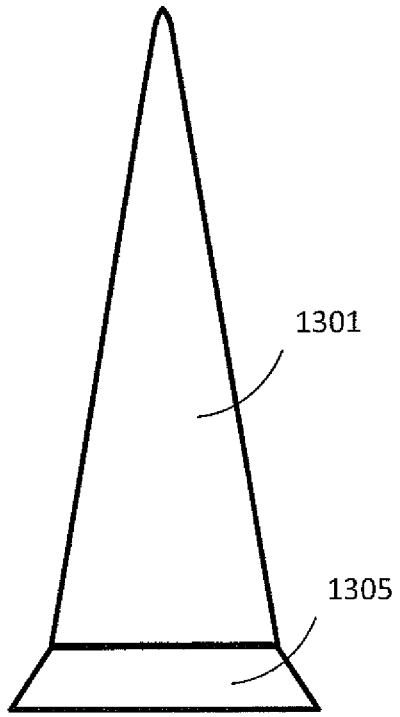
Figure 13D:
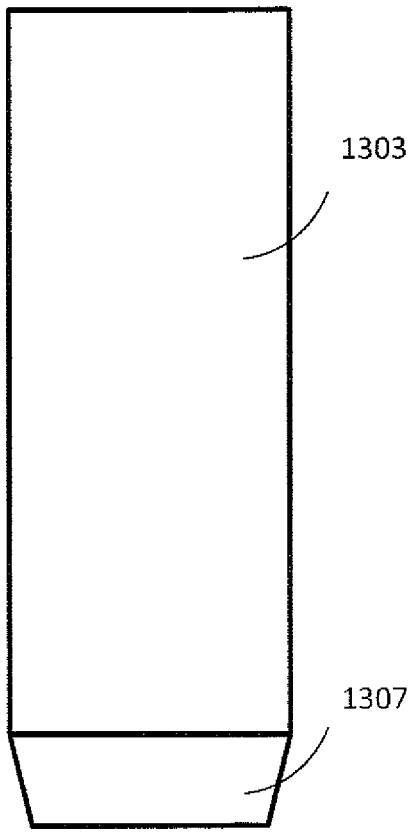
Figure 13E:
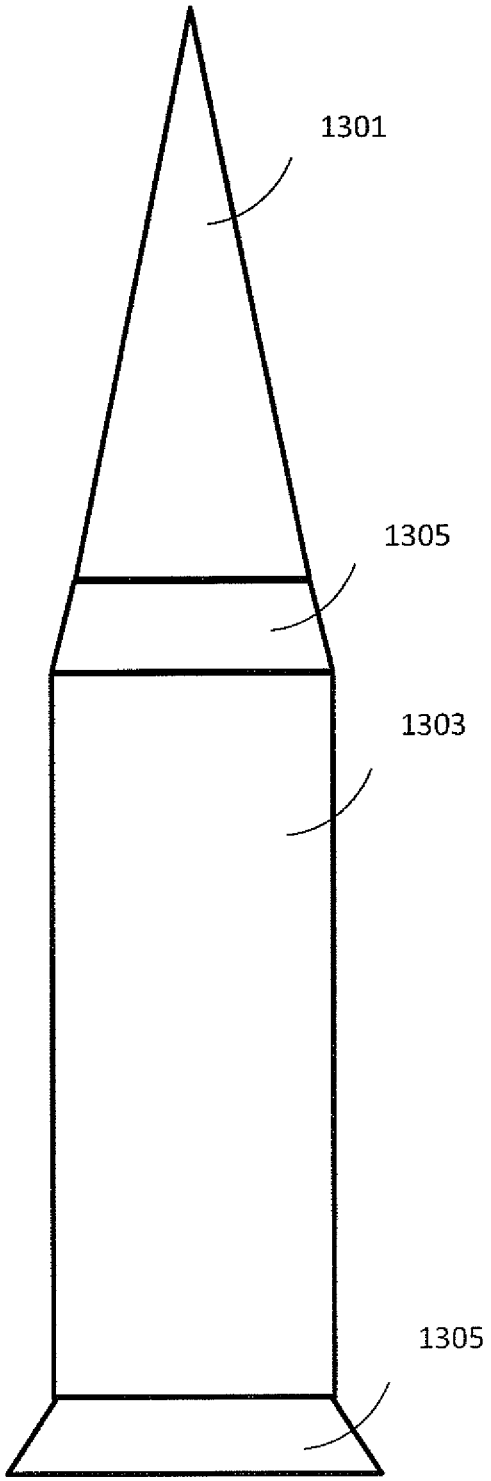

In certain embodiments, the dummy target can assume a cone shaped geometry, e.g. to resemble a re-entry vehicle. In certain other embodiments, the dummy target can assume a cylinder shaped geometry, e.g. to resemble a booster. In certain other embodiments, the dummy target can assume a complex geometry made up of one or more conical and/or frustoconical and/or cylindrical sections. Referring now to FIG. 13A, there is illustrated non-limiting examples of a dummy target having a cone shaped geometry 1301. Referring now to FIG. 13B, there is illustrated a dummy target having a cylinder shaped geometry 1303. Referring now to FIG. 13C, there is illustrated a dummy target having a complex geometry composed of several sections including a conical section 1301 and a concave frustoconical section 1305. The dummy target of FIG. 13C can be made to resemble, e.g. a body having a stabilization skirt e.g. a re-entry vehicle. Referring now to FIG. 13D, there is illustrated a dummy target having a complex geometry composed of several sections including a cylindrical section 1303 and a convex frustoconical section 1307. The dummy target of FIG. 13D can be made to resemble, e.g. a booster having a boat tail section. Referring now to FIG. 13E, there is illustrated a dummy target having a complex geometry composed of several sections including a conical section 1301, a cylindrical section 1303, and two concave frustoconical sections 1305.

In certain embodiments, the chassis of inflatable ducts detailed above includes one or more ducts made of a flexible, sealed and preferably lightweight material, e.g. polyamide or polyester based films like nylon 66, mylar, etc. The flexible material allows the chassis to be folded and packed in the carrier missile while occupying as little room as possible prior to the dummy target being released from the carrier missile and the chassis inflated with a gas, as detailed above. Instead of being inflated with a gas after deployment as detailed above, another option is seal a small amount of a gas in the inflatable ducts during manufacturing and no further inflation during deployment, since a small amount of gas can allow the ducts to be folded or compressed in the carrier missile (under atmospheric conditions), whilst still achieving the desired dummy target geometry once released from the carrier missile in space, without requiring additional inflation.

Figure 14A:
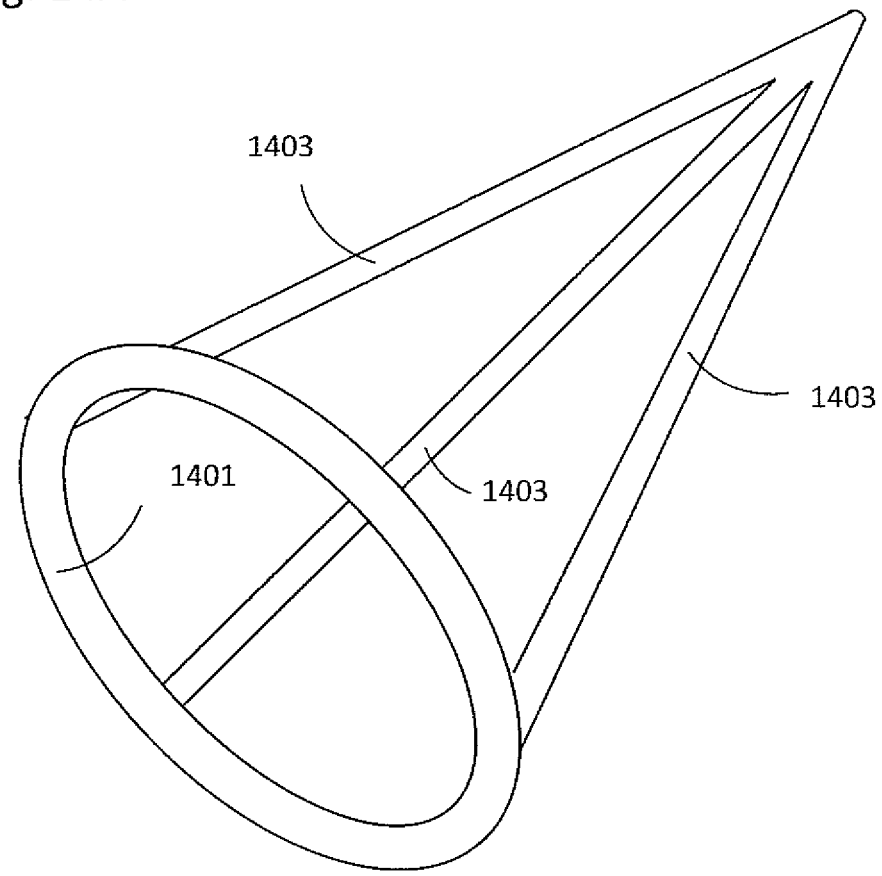
FIGS. 14A-B illustrate examples of inflatable chassis installed into inflatable dummy targets, in accordance with certain embodiments of the invention.
Figure 14B:
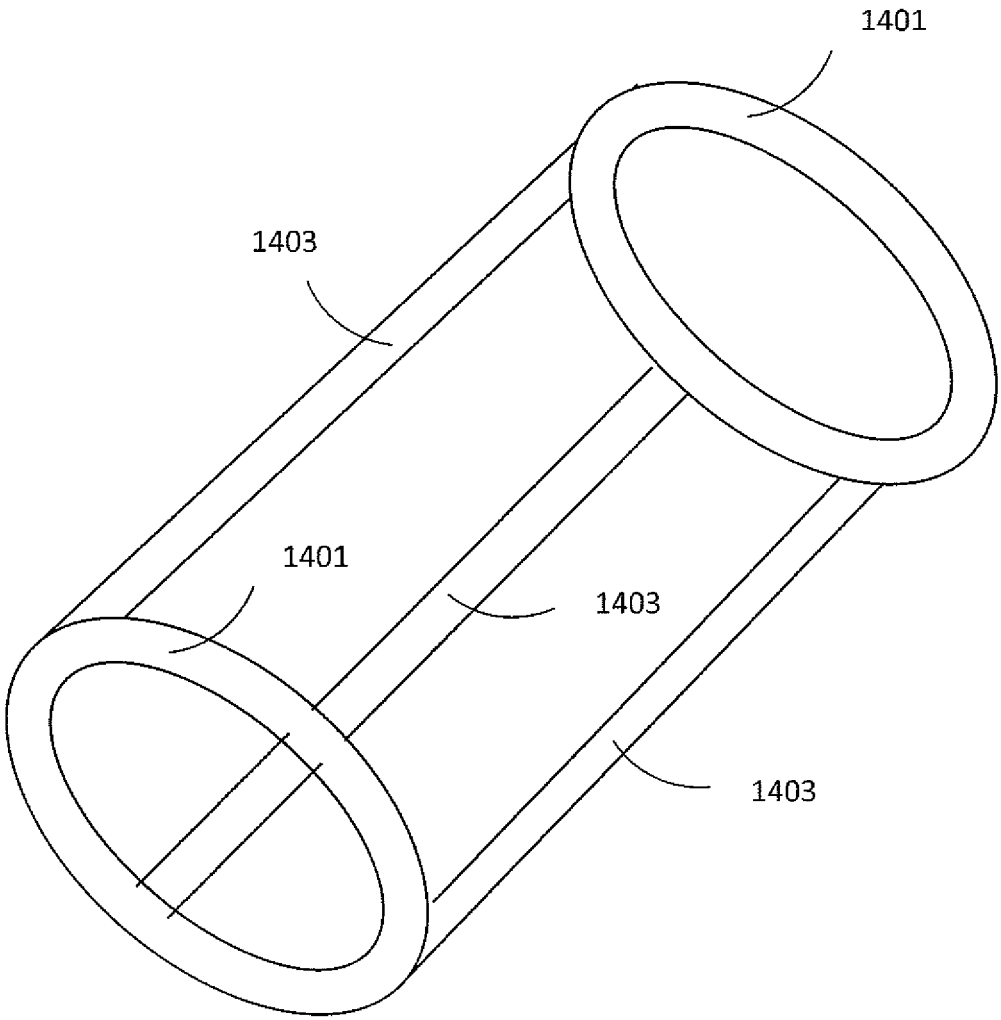
Figure 14C:
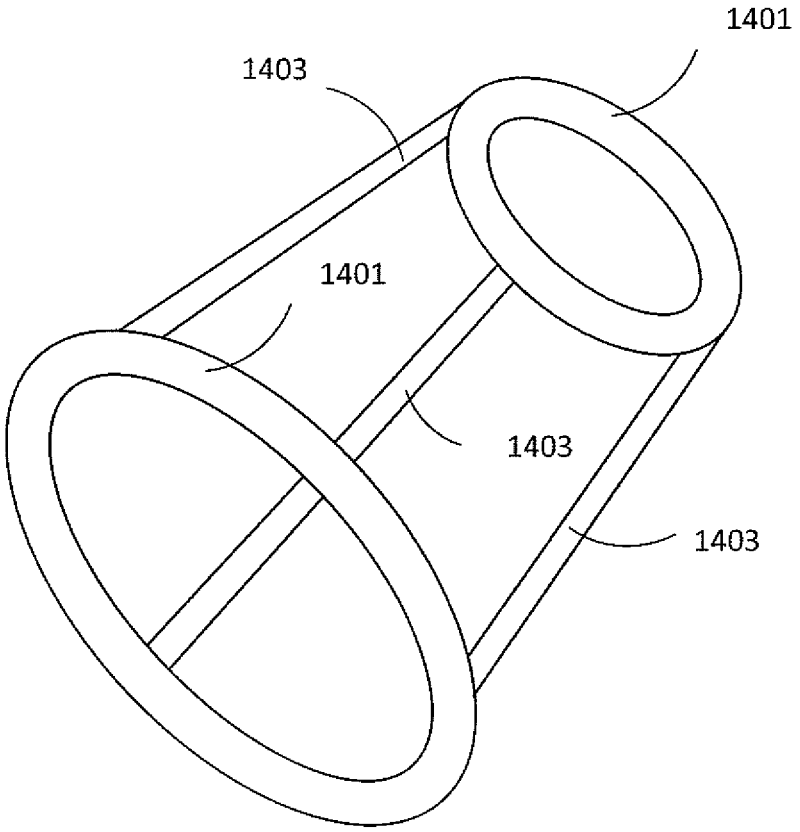
Figure 14D:
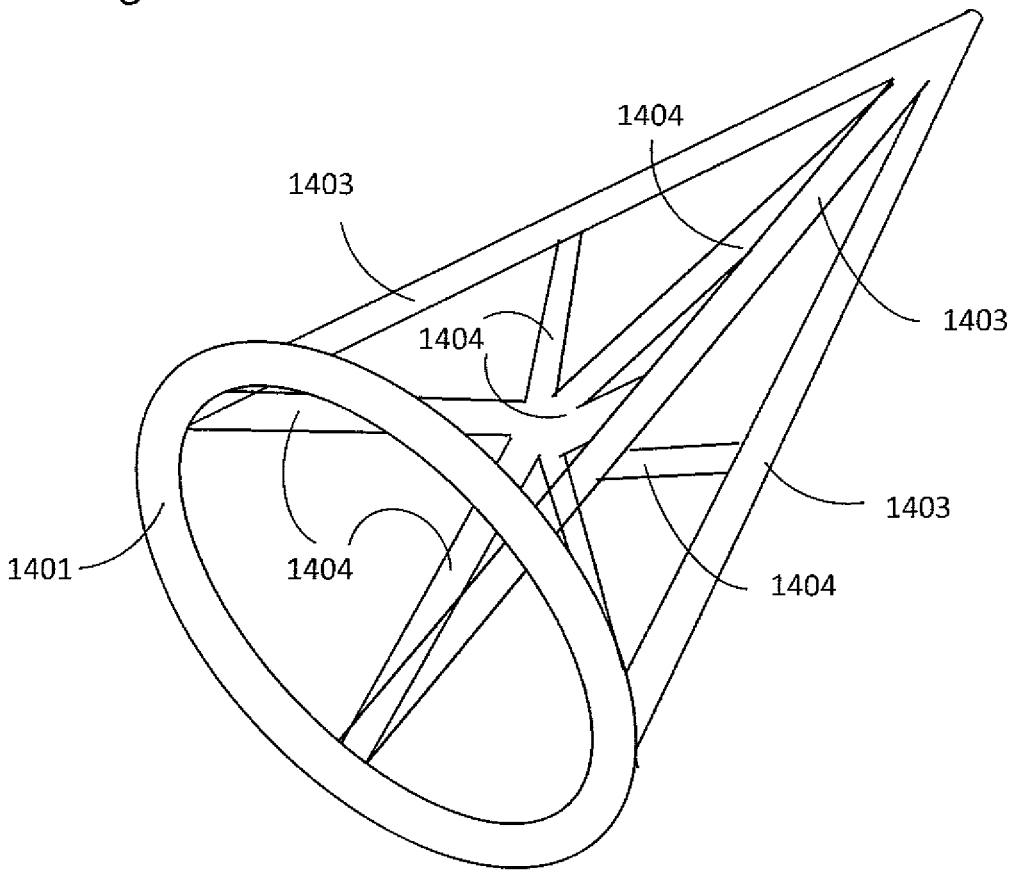

The individual ducts that form the chassis can be interconnected to one another in any manner that, once inflated, supports the wrapping sheet in the desired dummy target geometry. Referring now to FIG. 14A, there is illustrated a chassis of inflatable ducts arranged to support a cone shaped dummy target geometry when wrapped with a sheet (not shown) in which a ring shaped duct 1401 located at a base end of the chassis is connected to one or more elongate ducts 1403 which extend therefrom and are angled inward and converge at an opposite apex end of the chassis. Referring now to FIG. 14B, there is illustrated a chassis of inflatable ducts arranged to support a cylinder shaped dummy target geometry, in which two ring shaped ducts 1401 located at opposite base ends of the chassis are interconnected by one or more elongate ducts 1403 extending there between. Similar to cone, using of rings with bigger diameter respect to elongate ducts provides suppers of wrapped sheet by two rings only. In this case, a non-distorted cylindrical geometry can be achieved. Referring now to FIG. 14C, there is illustrated a chassis of inflatable ducts arranged to support a frustoconical shaped dummy target section, in which two ring shaped ducts 1401 (one having a circumference greater than the other) are connected by elongate ducts 1403 extending therebetween. It will be appreciated feat various different combinations of ring shaped ducts and elongate ducts can be used to support a wide range of axi-symmetrical either concave or convex dummy target geometries. Referring now to FIG. 14 D, there is illustrated an embodiment of a chassis of inflatable ducts incorporating additional elongate ducts 1404 for rigidizing the inflatable dummy target. Ring shaped duct 1401 and elongate ducts 1403 are supported by the additional rigidizing ducts 1404.

In certain embodiments, the wrapping sheet can be attached to the some of the ducts and not attached to other ducts. For example, in a cone shaped geometry, the wrapping sheet can be attached to the chassis at the ring shaped duct and not attached to the elongate ducts except at the apex. In a cylindrical shaped geometry, the wrapping sheet can be attached to the ring shaped ducts and not attached to the elongate ducts.

In certain embodiments, the chassis of inflatable ducts can comprise ducts of different diameters. In certain embodiments, a better target geometry is achieved if the ring shaped ducts have a larger diameter than the elongate ducts, e.g. a non-distorted target geometry can be achieved, even when the wrapping sheet is not attached to the elongate ducts (except, at the apex in the case of a cone).

The RF signature is achieved by using a material that has RF signature similar to that of the GTG missile (as discussed in detail with reference to the previous embodiments, above). As may be recalled in the previous embodiments, the IR signature was achieved by using a surface chemical heating by known per se electrically activated composition, which, upon activation, can generate a desired temperature which extends for a pre-defined duration by heating the dummy target surface by the gas injected inside the dummy target from gas generator, or by sun power heating of the dummy target skin coated by an appropriate optical layer. The latter method is applicable for daylight test conditions.

Figure 11A:
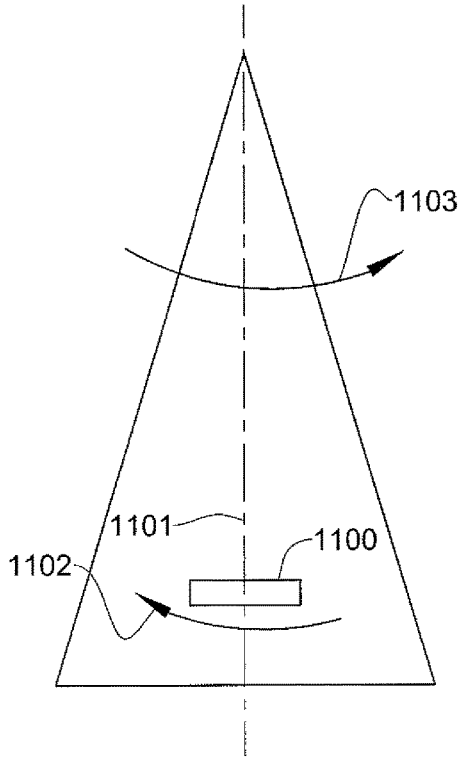
FIGS. 11A-B illustrate schematically means for generating appropriate flight dynamics in a dummy target, in accordance with certain embodiments of the invention.
Figure 11B:
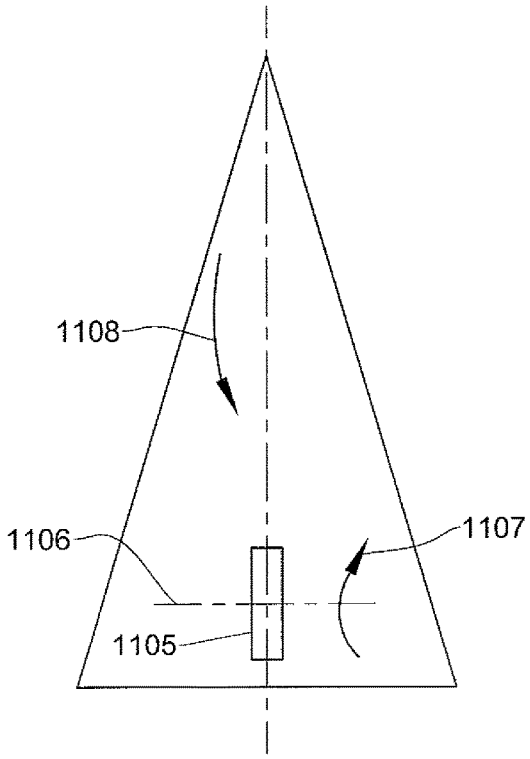

The invention is not bound to the means for generating flight dynamics in the manner specified above. Thus, in accordance with certain other embodiments and as illustrated with reference to FIG. 11A-B, a flywheel 1100 is fitted in the inflatable dummy target and is activated by a motor (not shown) at desired timing for rotating about axis 1101 (in a direction indicated by arrow 1102). As a result, the dummy target will rotate in an opposite direction (specified by arrow 1103) as stipulated by the respective inertial moments ratio, all as known per se, so as to achieve the desired roll dynamics. Turning to FIG. 11B, pitch dynamics are achieved by fitting a flywheel 1105 with a normal orientation relative to flywheel 1100. Flywheel 1105 rotates about axis 1106 in a direction indicated by arrow 1107 to thereby achieve rotation of dummy target in an opposite direction (specified by arrow 1108) as stipulated by the respective inertial moments ratio, all as known per se, so as to achieve the desired pitch dynamics. In order to achieve angular acceleration (or deceleration) so as to achieve the appropriate pitch and roll dynamics, the flywheels are accelerated/decelerated using the respective motors, all as known per se. The placement of flywheels in the manner specified, including the related motors and gimbals, is generally known per se and therefore not further expounded upon herein.

Figure 12:
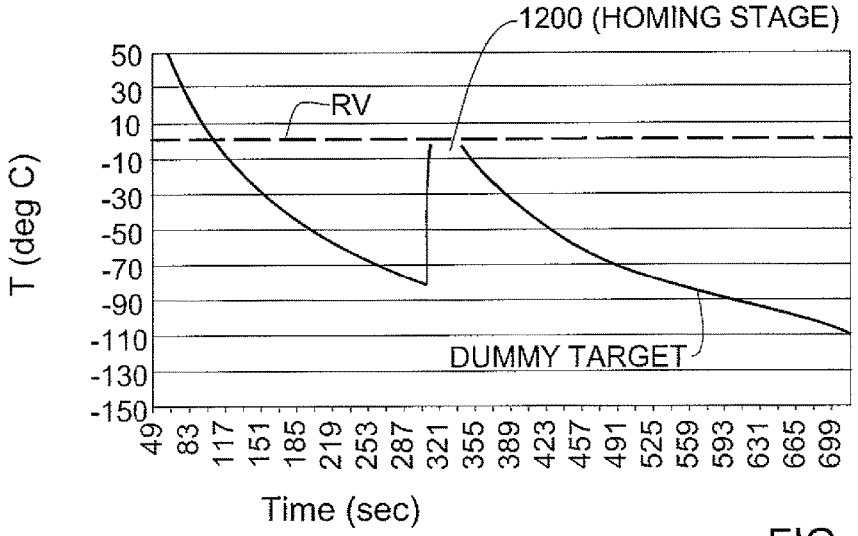
FIG. 12 illustrates schematically a IR signature activation curve, in accordance with certain embodiments of the invention.

As may be recalled, the trial is in fact fully controlled since the launch timing of the carrier and the interceptor are fully controlled, and likewise also the release timing of the dummy target as well as the timing of the interception and the location of the interception point are all planned in advance. It is also noted that the operational specification of the interceptor are well known insofar as the minimal distance from target that is required to sense IR signature are concerned. In other words, when the interceptor is too far away from the target (by this embodiment the dummy target) it is insensitive to the IR signature of the target. Accordingly, in accordance with certain embodiments, the dummy target's IR signature is activated only during the homing stage and the END GAME such that the interceptor can sense the IR signature. With reference to the embodiment of FIG. 12, this means that the electrically operated heating composition is activated at a predefined timing when the interceptor is sufficiently close to sense the IR signature of the target. This enables to activate the IR signature generation means for only a limited period. This is illustrated in FIG. 12, which illustrates schematically an IR signature activation cone, in accordance with certain embodiments of the invention. As shown, the IR signature is activated only at the homing stage and the END GAME 1200 (i.e. when the temperature rises). Whilst the description with reference to FIG. 12 exemplified activation of the IR signature not throughout the entire exo-atmospheric flight session (i.e. through only a partial session, such as the homing stage and the END GAME), the invention is not bound to activate only IR signature through a partial exo-atmospheric flight session. Thus, other characteristics, such as RF signature and generating desired dummy target dynamics may be activated through partial session such as the homing stage and the END GAME.

As specified above, the carrier is capable of acquiring a sky view of the kill scene. In accordance with certain embodiments, this is achieved by utilizing the technique disclosed in WO 2006/025049 "a system and method for destroying a flying object".

Those of ordinary skill in the art will readily appreciate that in accordance with various embodiments of the invention there is provided a method for simplifying exo-atmospheric Ground-to-Ground (GTG) missile's interception trial, that includes:

(a) providing at least one dummy target that is manufacturable in a considerably simpler manufacturing process than a GTG missile, and capable of manifesting characteristics that resemble characteristics of the GTG missile;

(b) providing a common carrier missile capable of accommodating at least one dummy target irrespective of the characteristics thereof;

whereby said common carrier missile is capable of being launched and being configured to release at least one dummy target at a selected exo-atmospheric location, for testing the ability of an interceptor missile to intercept said dummy target at an exo-atmospheric interception point, thereby testing the interceptor's operational feasibility to destroy the GTG missile.

(c) providing kill assessment information from the kill scene including achieved miss distance, angle of incidence etc.

As used herein, the phrase "for example," "such as" and variants thereof describing exemplary implementations of the present invention are exemplary in nature and not limiting. Reference in the specification to "one embodiment", "an embodiment". "some embodiments", "another embodiment", "other embodiments" or variations thereof mean that a particular feature, structure or characteristic described in connection with the embodiment(s) is included in at least one embodiment of the invention. Thus the appearance of the phrase "one embodiment", "an embodiment", "some embodiments", "another embodiment", "other embodiments" or variations thereof do not necessarily refer to the same embodiment(s). It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub-combination. While the invention has been shown and described with respect to particular embodiments, it is not thus limited. Numerous modifications, changes and improvements within the scope of the invention will now occur to the reader. In embodiments of the invention, fewer, more and/or different stages than those shown in the drawings may be executed.

The present invention has been described with a certain degree of particularity, but those of ordinary skill in the art will readily appreciate that various alterations and modifications may be carried out without departing from the scope of the following Claims.

The invention claimed is:

1. An inflatable dummy target comprising a chassis wrapped with a sheet, the chassis formed by individual inflatable ducts, wherein the chassis comprises at least two ring-shaped ducts interconnected by one or more elongate ducts, and the dummy target geometry is conical shaped and the chassis comprises a ring-shaped duct positioned at a base end of the chassis connected to a plurality of elongate ducts extending therefrom and angled inward and converging at an apex end of the chassis.

2. The inflatable dummy target of claim 1, wherein the sheet is attached to the chassis only at the base end and the apex.

3. The inflatable dummy target of claim 1, wherein the chassis further comprises rigidizing ducts.

4. An inflatable dummy target comprising a chassis wrapped with a sheet, the chassis formed by individual inflatable ducts, wherein the chassis comprises at least two ring-shaped ducts interconnected by one or more elongate ducts, each ring shaped duct is connected to at least one elongate duct, and the dummy target geometry is cylindrical shaped and the chassis comprise a first ring shaped duct positioned at a first base end, a second ring shaped duct positioned at an opposite base end of the chassis, and a plurality of elongate ducts connected to the first and second ring shaped ducts and extending therebetween.

5. The inflatable dummy target of claim 4, wherein the sheet is attached to the chassis only at the base ends.

6. The inflatable dummy target of claim 4, wherein the chassis further comprises rigidizing ducts.

7. An inflatable dummy target comprising several attached axi-symmetrical sections, wherein each section has a chassis wrapped with a sheet, the chassis formed by individual inflatable ducts, and the shape of each section is selected so that the inflatable dummy target is comprised of a conical section attached to frustoconical section, thereby achieving a concave dummy target geometry or the inflatable dummy target is comprised of a cylindrical section attached to frustoconical section, thereby achieving a convex dummy target geometry.

* * * * *